US007693478B2

(12) United States Patent
Tanaka et al.

(10) Patent No.: US 7,693,478 B2
(45) Date of Patent: Apr. 6, 2010

(54) IMAGE-FORMING APPARATUS HAVING AN APPROACH AND SEPARATION MECHANISM

(75) Inventors: Shigeru Tanaka, Ebina-shi (JP); Tomokazu Kurita, Ebina-shi (JP); Satoshi Honobe, Ebina-shi (JP); Kazuaki Iikura, Saitama-shi (JP); Junichi Ozawa, Ebina-shi (JP); Hiroki Ando, Ebina-shi (JP); Taro Mitsui, Ebina-shi (JP); Yukihiro Ichiki, Ebina-shi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 90 days.

(21) Appl. No.: 12/055,373

(22) Filed: Mar. 26, 2008

(65) Prior Publication Data

US 2009/0052960 A1 Feb. 26, 2009

(30) Foreign Application Priority Data

Aug. 21, 2007 (JP) ..... 2007-215005

(51) Int. Cl.
*G03G 15/00* (2006.01)
*G03G 15/04* (2006.01)
*G03G 21/10* (2006.01)

(52) U.S. Cl. ..... 399/358; 399/110; 399/123

(58) Field of Classification Search ..... 399/358, 399/123, 111, 110, 119, 120, 125, 107; 347/138, 347/152

See application file for complete search history.

(56) References Cited

U.S. PATENT DOCUMENTS 5,477,306 A * 12/1995 Iguchi et al. ..... 399/46
5,999,771 A * 12/1999 Wakihara ..... 399/117
2008/0050158 A1 * 2/2008 Hatayama et al. ..... 399/358

FOREIGN PATENT DOCUMENTS

JP 04-366855 A * 12/1992
JP 05-249767 A * 9/1993
JP 07-261619 A * 10/1995
JP 2001-296712 A * 10/2001
JP 2006-018127 A * 1/2006
JP 2006-58454 A 3/2006

* cited by examiner

*Primary Examiner*—Sophia S Chen
(74) *Attorney, Agent, or Firm*—Sughrue Mion, PLLC

(57) ABSTRACT

An image-forming apparatus includes: an image carrier; a latent image-forming unit for forming a latent image on the image carrier; a cleaning unit including a residue removal member a residue transport member; a residue collecting unit having an receiving port adapted to be able to connect to and be away from the ejecting port and to receive the residue ejected from the ejection port; a shield member capable of shifting between an ejection position and a shield position; and an approach and separation mechanism that moves the latent image-forming unit between an approach position where the latent image-forming unit approaches the image carrier and a separate position where the latent image-forming unit is separated from the image carrier, the approach and separation mechanism allowing the latent image-forming unit to move to the separation position as the shield member shifts to the shield position.

22 Claims, 26 Drawing Sheets

IMAGE-FORMING APPARATUS HAVING AN APPROACH AND SEPARATION MECHANISM

CROSS-REFERENCE TO RELATED APPLICATION

This application is based on and claims priority under 35 USC §119 from Japanese Patent Application No. 2007-215005 filed Aug. 21, 2007.

BACKGROUND

Technical Field

This invention relates to an image-forming apparatus.

SUMMARY

According to an aspect of the invention, there is provided an image-forming apparatus comprising:

an image carrier;

a latent image-forming unit that forms a latent image on a surface of the image carrier;

a cleaning unit for the image carrier, the cleaning unit including a residue removal member that removes a residue deposited on the surface of the image carrier and a residue transport member that transports the residue removed by the residue removal member to an ejecting port for ejecting the removed residue;

a residue collecting unit having an receiving port adapted to be able to connect to and be away from the ejecting port and to receive the residue ejected from the ejection port;

a shield member capable of shifting between an ejection position where the residue is ejected from the ejection port to the receiving port and a shield position where the shield member shields the ejection port so that the residue is not ejected from the ejection port; and at least one of approach and separation mechanisms selected from a first approach and separation mechanism and a second approach and separation mechanism, wherein the first and second approach and separation mechanisms move the latent image-forming unit between an approach position where the latent image-forming unit approaches the image carrier and a separate position where the latent image-forming unit is separated from the image carrier, and the first approach and separation mechanism allows the latent image-forming unit to move to the separation position as the shield member shifts to the shield position, and the second approach and separation mechanism restricts a movement of the latent image-forming unit to the separation position in a state in which the shield member is placed at the ejection position.

BRIEF DESCRIPTION OF THE DRAWINGS

Embodiments of the present invention will be described in detail based on the following figures, wherein:

FIG. 3 is schematic drawings to describe the relationship among an image carrier, a latent image-forming unit, and a developing device in the image-forming apparatus of the first embodiment of the invention.

FIG. 4 is perspective schematic drawings of the latent image-forming unit of the first embodiment of the invention.

FIG. 5 is a schematic drawing of an outer frame of the latent image-forming unit of the first embodiment of the invention.

FIG. 6 is schematic drawings to describe the positional relationship between the latent image-forming unit and the image carrier of the first embodiment of the invention.

FIG. 7 is a schematic drawing of the main part of an approach and separation mechanism of the latent image-forming unit of the first embodiment of the invention in a state in which a part of the outer frame is not shown from the state shown in FIG. 4.

FIG. 8 is a schematic drawing of an operation joint member of the latent image-forming unit of the first embodiment of the invention.

FIG. 9 is a schematic drawing of a movement member of the latent image-forming unit of the first embodiment of the invention.

FIG. 11 is a schematic drawing of a movement direction conversion member of the latent image-forming unit of the first embodiment of the invention.

FIG. 12 is schematic drawings of an interlocking contact member provided in the latent image-forming unit of the first embodiment of the invention.

FIG. 13 is schematic drawings of an approach and separation member of the latent image-forming unit of the first embodiment of the invention.

FIG. 14 is schematic drawings of an image-writing light irradiation unit of the latent image-forming unit of the first embodiment of the invention.

FIG. 19 is schematic drawings of the function when the latent image-forming unit and the developing device of the first embodiment of the invention are separated from the image carrier.

Figure 1:
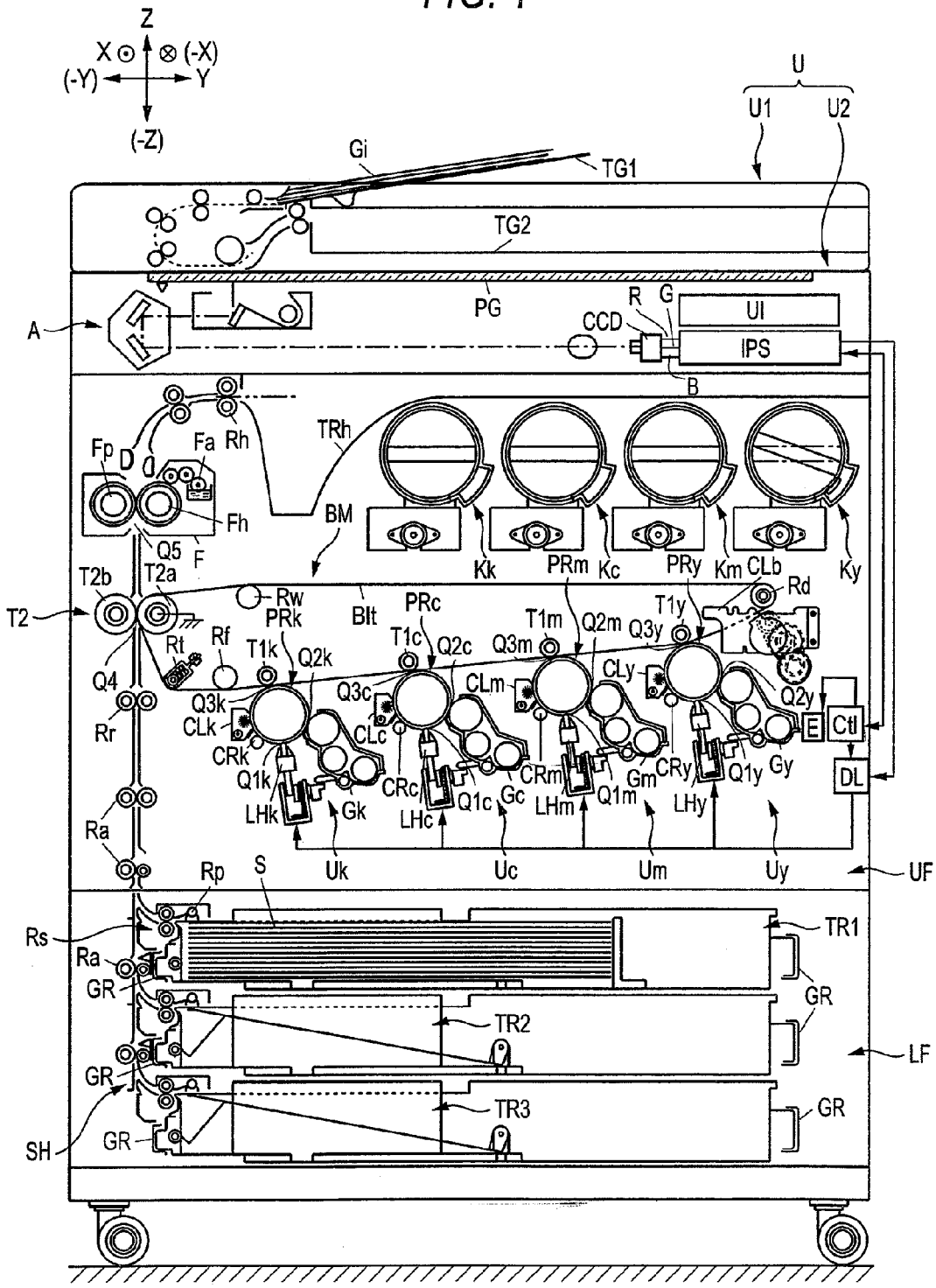
FIG. 1 is a schematic drawing of the whole of an image-forming apparatus of a first exemplary embodiment of the invention.

11-22: Approach and separation mechanism of latent image-forming unit;
12: Operation member;
12*c*+47*c*: Interlocking mechanism;
23*b*: Light-emitting surface;
32: Developer replenishment passage;
44: Residue transport member;
46*a*: Ejection port;
47: Shield member;
47*c*: Interlocking part;
49: Spring for shutter movement;
51: Residue collector;
52*a*: Receiving port;
54: Ejected residue transport member;
56: Residue collection vessel;
61: Entry shielding part;
CLy, CLm, CLc, CLk: Image carrier cleaner;
Gy, Gm, Gc, Gk: Developing device;
LHy, LHm, LHc, LHk: Latent image-forming unit;
PRy, PRm, PRc, PRk: Image carrier; and
U: Image-forming apparatus.

DETAILED DESCRIPTION

Referring now to the accompanying drawings, there are shown exemplary embodiments of the invention. However, the invention is not limited to the following embodiments.

For easy understanding of the description to follow, in the accompanying drawings, back and forth direction is X axis direction, side to side direction is Y axis direction, and up and down direction is Z axis direction, and directions or sides indicated by arrows X, −X, Y, −Y, Z, and −Z are forward, backward, rightward, leftward, upward, and downward or front, rear (back), right, left, upper side (top), and lower side (bottom).

In the accompanying drawings, a mark including a dot described in a circle means an arrow from the back of the plane of the drawing to the surface and a mark including X described in a circle means an arrow from the surface of the plane of the drawing to the back.

In the description that follows using the accompanying drawings, members other than the members required for the description are not shown in the drawings where appropriate for easy understanding of the description.

First Embodiment

FIG. 1 is a schematic drawing of the whole of an image-forming apparatus of a first exemplary embodiment of the invention.

In FIG. 1, an image-forming apparatus U includes an automatic document transport unit U1 and an image-forming apparatus main body U2 for supporting the unit U1, the main body U2 having on the top a transparent plane PG for reading a document.

The automatic document transport unit U1 has a document feed section TG1 for stacking a plurality of document sheets Gi to be copied for storage and a document ejection section TG2 for ejecting the document Gi fed from the document feed section TG1 and transported through a document read position on the document read plane PG.

The image-forming apparatus main body U2 has an operation section UI for the user to enter an operation command signal of image formation operation start, etc., an exposure optical system A, and the like.

Reflected light from the document transported on the document read plane PG in the automatic document transport unit U1 or the document manually placed on the document read plane PG is converted into electric signals of red R, green G, and blue B by a solid-state imaging device or a charge-coupled device CCD through the exposure optical system A.

An image information-conversion section IPS converts the electric signals of RGB input from the solid-state imaging device CCD into image information of black K, yellow Y, magenta M, and cyan C, temporarily stores the image information, and outputs the image information to a drive circuit DL for a latent-image forming unit as image information to form a latent image at a timing.

If the document image is a single-color image, namely, is monochrome, image information of only black K is input to the latent image-forming unit drive circuit DL.

The latent image-forming unit drive circuit DL has drive circuits of colors Y, M, C, and K (not shown) and outputs the signal responsive to the input image information to latent image-forming units LHy, LHm, LHc, and LHk placed in a one-to-one correspondence with the colors Y, M, C, and K at a timing.

Figure 2:
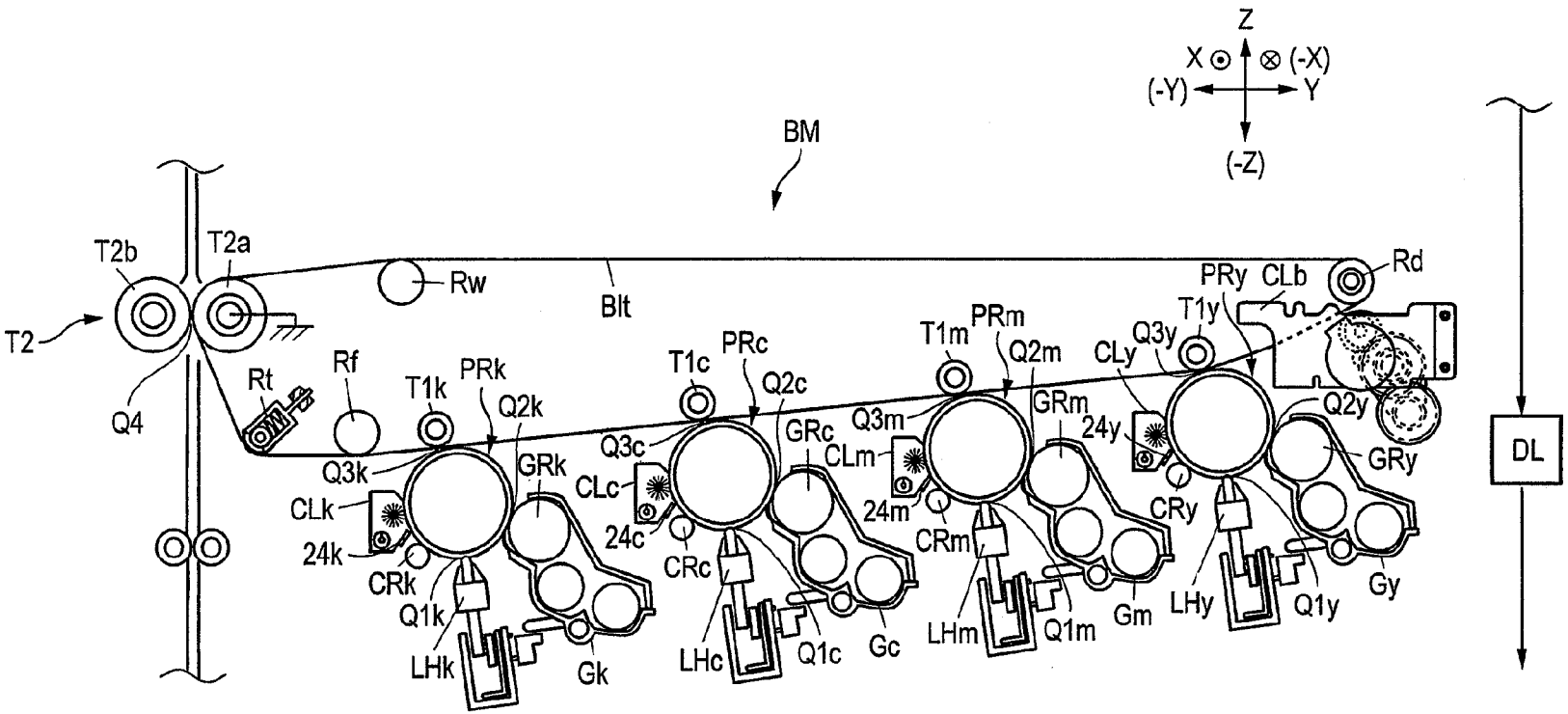
FIG. 2 is an enlarged schematic drawing of the main part of the image-forming apparatus of the first embodiment of the invention.

FIG. 2 is an enlarged schematic drawing of the main part of the image-forming apparatus of the first embodiment of the invention.

Visible image-forming units Uy, Um, Uc, and Uk placed in the center of the image-forming apparatus U in the gravity direction thereof are units for forming visible images of Y, M, C, and K colors respectively.

Latent-image-writing light Ly, Lm, Lc, and Lk of Y, M, C, and K emitted from latent-image-writing light sources of the latent image-forming units LHy, LHm, LHc, and LHk are incident on rotating image carriers PRy, PRm, PRc, and PRk. In the first embodiment, the latent image-forming units LHy, LHm, LHc, and LHk are implemented as an LED array.

The visible image formation unit Uy of Y has the rotating image carrier PRy, a charger CRy, the latent image-forming unit LHy, a developing device Gy, a transfer device T1*y*, and an image carrier cleaner CLy. In the first embodiment, the image carrier PRy, the charger CRy, and the image carrier cleaner CLy are formed as an image carrier unit that can be attached to and detached from the image-forming apparatus main body U2 in one piece.

Each of the visible image-forming units Um, Uc, and Uk is configured like the visible image formation unit Uy of Y.

In FIGS. 1 and 2, the image carriers PRy, PRm, PRc, and PRk are charged by chargers CRy, CRm, CRc, and CRk and then electrostatic latent images are formed on the surfaces of the image carriers PRy, PRm, PRc, and PRk at image write positions Q1*y*, Q1*m*, Q1*c*, and Q1*k* according to the latent-image-writing light Ly, Lm, Lc, and Lk. The electrostatic latent images on the surfaces of the image carriers PRy, PRm, PRc, and PRk are developed to toner images as an example of visible images in developers held on developing rolls GRy, GRm, GRc, and GRk as an example of developer holding bodies of developing devices Gy, Gm, Gc, and Gk in developing areas Q2*y*, Q2*m*, Q2*c*, and Q2*k*.

The developed toner images are transported to primary transfer areas Q3*y*, Q3*m*, Q3*c*, and Q3*k* coming in contact with an intermediate transfer belt Blt as an example of an intermediate transfer body. Primary transfer voltage of the opposite polarity to the charge polarity of toner is applied at a timing from a power supply circuit E controlled by a control section Ctl to primary transfer devices T1*y*, T1*m*, T1*c*, and T1*k* placed on the back of the intermediate transfer belt Blt in the primary transfer areas Q3*y*, Q3*m*, Q3c, and Q3*k*.

The toner images on the image carriers PRy, PRm PRc, and PRk are primary-transferred to the intermediate transfer belt Blt by the primary transfer devices T1*y*, T1*m*, T1*c*, and T1*k*. Residues and deposits on the surfaces of the image carriers PRy, PRm, PRc, and PRk after the primary transfer are cleaned by image carrier cleaners CLy, CLm, CLc, and CLk. The cleaned surfaces of the image carriers PRy, PRm, PRc, and PRk are again charged by the chargers CRy, CRm, CRc, and CRk.

A belt module BM as an example of an intermediate transfer device that can move up and down and can be drawn out forward is placed above the image carriers PRy, PRm, PRc, and PRk. The belt module BM has the above-mentioned intermediate transfer belt Blt, a belt drive roll Rd as an example of an intermediate transfer body drive member, a tension roll Rt as an example of an intermediate transfer body tension member, a walking roll Rw as an example of a meandering prevention member, an idler roll Rf as an example of a driven member, a backup roll T2*a* as an example of a secondary transfer area facing member, and the above-mentioned primary transfer devices T1*y*, T1*m*, T1*c*, and T1*k*. The intermediate transfer belt Blt is supported by belt support rolls Rd, Rt, Rw, Rf, and T2*a* as an example of intermediate transfer body support members made up of the rolls Rd, Rt, Rw, Rf, and T2*a* for rotation.

A secondary transfer roll T2*b* as an example of a secondary transfer member is placed facing to the surface of the intermediate transfer belt Blt in contact with the backup roll T2*a* and the rolls T2*a* and T2*b* make up a secondary transfer device T2. A secondary transfer area Q4 is formed in the area facing to the secondary transfer device T2 and the intermediate transfer belt Blt.

Single-color or multi-color toner images transferred onto the intermediate transfer belt Blt in order in an overlap manner by the primary transfer devices T1*y*, T1*m*, T1*c*, and T1*k* in the primary transfer areas Q3*y*, Q3*m*, Q3*c*, and Q3*k* are transported to the secondary transfer area Q4.

A pair of left and right guide rails GR as an example of guide members is provided at three stages below the visible image-forming units Uy, Um, Uc, and Uk, and sheet feed trays TR1 to TR3 as an example of sheet feed vessels are supported on the guide rails GR as they can go in and out in a back and forth direction. Record sheets S as an example of media stored in the sheet feed trays TR1 to TR3 are taken out by a pickup roll Rp as an example of a medium taking out member and are separated one at a time by a handling roll Rs as an example of a medium handling member. The record sheet S is transported by a plurality of transport rolls Ra as an example of medium transport members along a sheet transport passage SH as an example of a medium transport passage and is delivered to a registration roll Rr as an example of a transfer area transport timing adjustment member placed upstream in the sheet transport direction of the secondary transfer area Q4. The sheet transport passage SH, the sheet transport rolls Ra, the registration roll Rr, and the like make up a sheet transporter SH+Ra+Rr.

The registration roll Rr transports the record sheet S to the secondary transfer area Q4 at the timing at which the toner image formed on the intermediate transfer belt Blt is transported to the secondary transfer area Q4. When the record sheet S passes through the secondary transfer area Q4, the backup roll T2a is grounded and secondary transfer voltage of the opposite polarity to the charge polarity of the toner is applied from the power supply circuit E controlled by the control section Ctl to the secondary transfer roll T2*b*. At this time, the toner image on the intermediate transfer belt Blt is transferred to the record sheet S by the secondary transfer device T2.

The intermediate transfer belt Blt after the secondary transfer is cleaned by a belt cleaner CLb as an example of an intermediate transfer body cleaner.

The record sheet S to which the toner image is secondary-transferred is transported to a fixing area Q5 of a press contact area of a heating roll Fh as an example of a heating fixing member of a fixing unit F and a pressurization roll Fp as an example of a pressurization fixing member of the fixing unit F and is heated and fixed when the record sheet S passes through the fixing area. The heated and fixed record sheet S is ejected from an ejection roller Rh as an example of a medium ejection member to a sheet ejection tray TRh as an example of a medium ejection section.

A mold release agent to provide good releasability of the record sheet S from the heating roll Fh is applied to the surface of the heating roll Fh by a mold release agent-application unit Fa.

Developer cartridges Ky, Km, Kc, and Kk as an example of developer replenishment vessels for storing developers of yellow Y, magenta M, cyan C, and black K are placed above the belt module BM. The developing devices Gy, Gm, Gc, and Gk are replenished with the developers stored in the developer cartridges Ky, Km, Kc, and Kk from developer replenishment passages (described later) in response to the consumption of the developers by the developing devices Gy, Gm, Gc, and Gk. In the first embodiment, the developer is implemented as a dual-component developer containing a magnetic carrier and toner to which an outer additive is given.

In FIG. 1, the image-forming apparatus Uhas an upper frame UF and a lower frame LF and the upper frame UF supports the visible image-forming units Uy, Um, Uc, and Uk, and members placed above the visible image-forming units Uy, Um, Uc, and Uk, namely, the belt module BM, etc.

The lower frame LF supports the guide rails GR for supporting the sheet feed trays TR1 to TR3 and the sheet feed members for feeding a sheet from the sheet feed trays TR1 to TR3, namely, the pickup roll Rp, the handling roll Rs, the sheet transport rolls Ra, etc.

(Description of Members of Visible Image-forming Units)

Figure 3A:
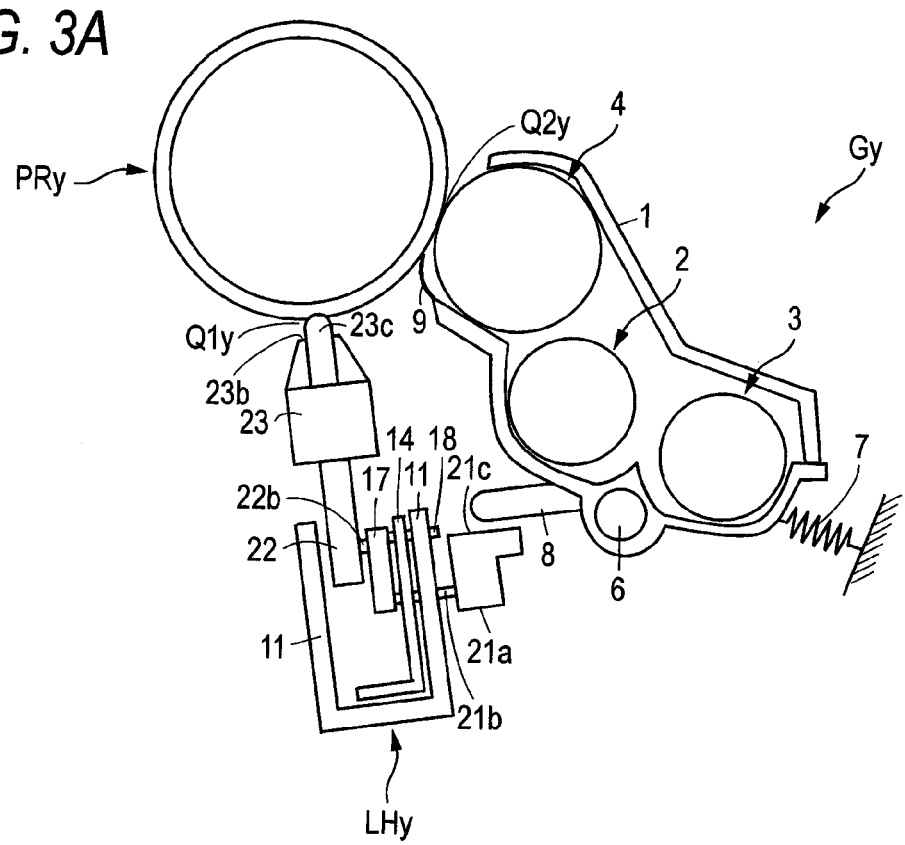
FIG. 3A is a schematic drawing to show a state in which the developing device moves to a developing device approach position and the latent image-forming unit moves to a latent image-forming unit approach position.
Figure 3B:
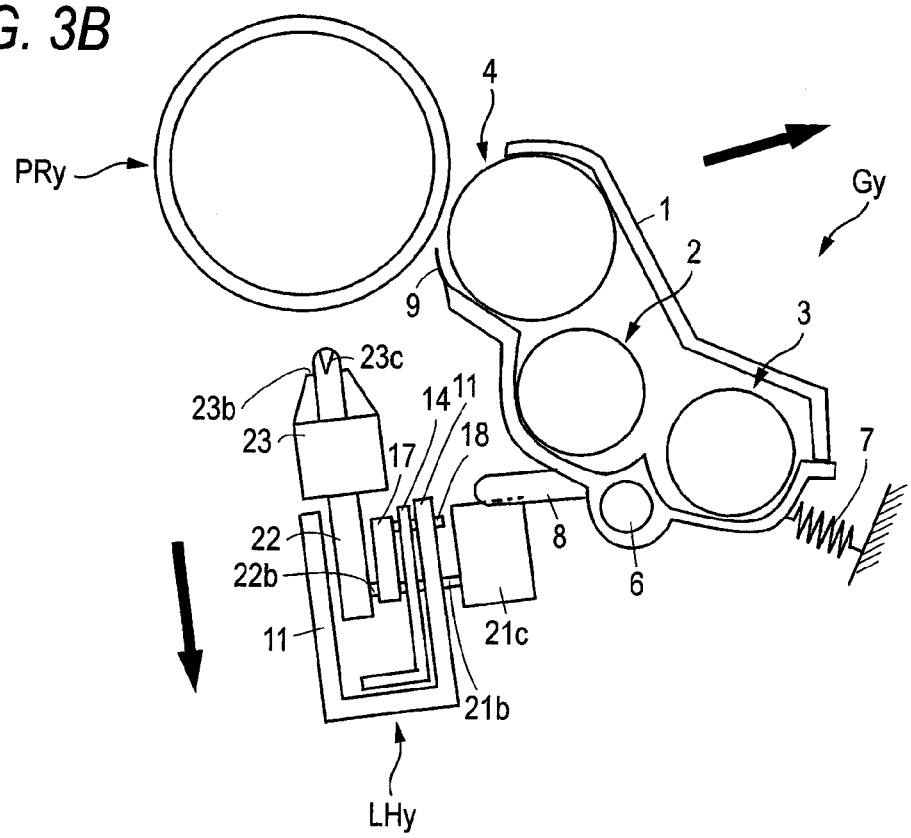
FIG. 3B is a schematic drawing to show a state in which the developing device moves to a developing device separation position and the latent image-forming unit moves to a latent image-forming unit separation position.

FIG. 3 is schematic drawings to describe the relationship among the image carrier, the latent image-forming unit, and the developing device in the image-forming apparatus of the first embodiment of the invention; FIG. 3A is a schematic drawing to show a state in which the developing device moves to a developing device approach position (i.e., a position of the developing device approaching the image carrier) and the latent image-forming unit moves to a latent image-forming unit approach position (a position of the latent image-forming unit approaching the image carrier); and FIG. 3B is a schematic drawing to show a state in which the developing device moves to a developing device separation position (i.e., a position of the developing device separating from the image carrier) and the latent image-forming unit moves to a latent image-forming unit separation position (i.e., a position of the latent image-forming unit separating from the image carrier).

Next, the developing devices Gy, Gm, Gc, and Gk and the latent image-forming units LHy, LHm, LHc, and LHk making up the visible image-forming units Uy, Um, Uc, and Uk of the first embodiment of the invention will be discussed. However, the Y, M, C, and K color members have similar configurations and therefore only the Y (yellow) color members will be discussed and the M, C, and K color members will not be discussed in detail.

(Description of Developing Device)

In FIG. 3, the developing device Gy of the first embodiment has a developer vessel 1 in which a developer is stored. In the developer vessel 1, a pair of agitation transport members 2 and 3 for transporting the internal developer while agitating it are supported rotatably. In the developer vessel 1, a developer holding body 4 for holding the developer agitated by the agitation transport members 2 and 3 on the surface and transporting the developer to the developing area Q2*y* of the opposed area to the image carrier PRy is supported rotatably.

In FIG. 3, the developer vessel 1 is supported on a developing unit frame (not shown) for rotation on a rotation shaft 6. One end of a developing device urging member 7 for urging the developer holding body 4 toward the side of the image carrier PRy at all times is supported on an outer wall of the developer vessel 1 on the opposite side to the image carrier PRy with respect to the rotation shaft 6. Therefore, the developer holding body 4 receives a force in the direction in which it is pressed against the side of the image carrier PRy, and the spacing between the developer holding body 4 and the developer vessel 1 is kept in a spacing by developing area abutment parts or tracking parts (not shown) placed at both ends of the developer holding body 4. That is, at the usual time, the developing device Gy is held at the developing device approach position shown in FIG. 3A. If an external force for rotating in the direction in which the developing device Gy is away from the image carrier PRy acts, the developing device Gy is away from the image carrier Pry against the force of the developing device urging member 7. That is, the rotation shaft 6 and the developing device urging member 7 make up a developing device approach and separation mechanism 6+7.

An interlocking contacted member 8 extending to the latent image-forming unit LHy side is supported on an outer wall of the latent image-forming unit LHy side of the developer vessel 1. Further, a leakage prevention member 9 for coming in contact with the surface of the image carrier PRy and preventing downward leakage of the developer is supported below the developer holding body 4 of the developer vessel 1.

(Description of Latent Image-forming Unit)

Figure 4A:
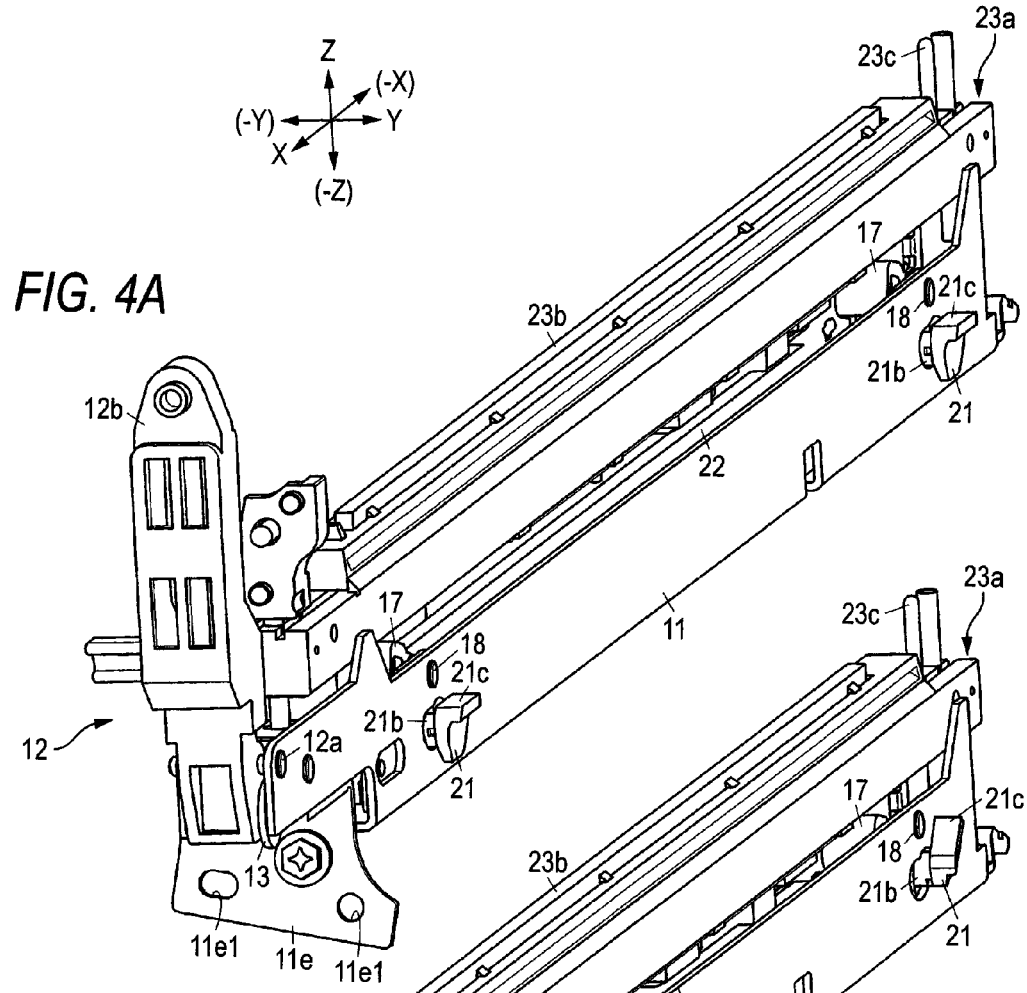
FIG. 4A is a schematic drawing to show a state in which the latent image-forming unit moves to a latent image-forming approach position.
Figure 4B:
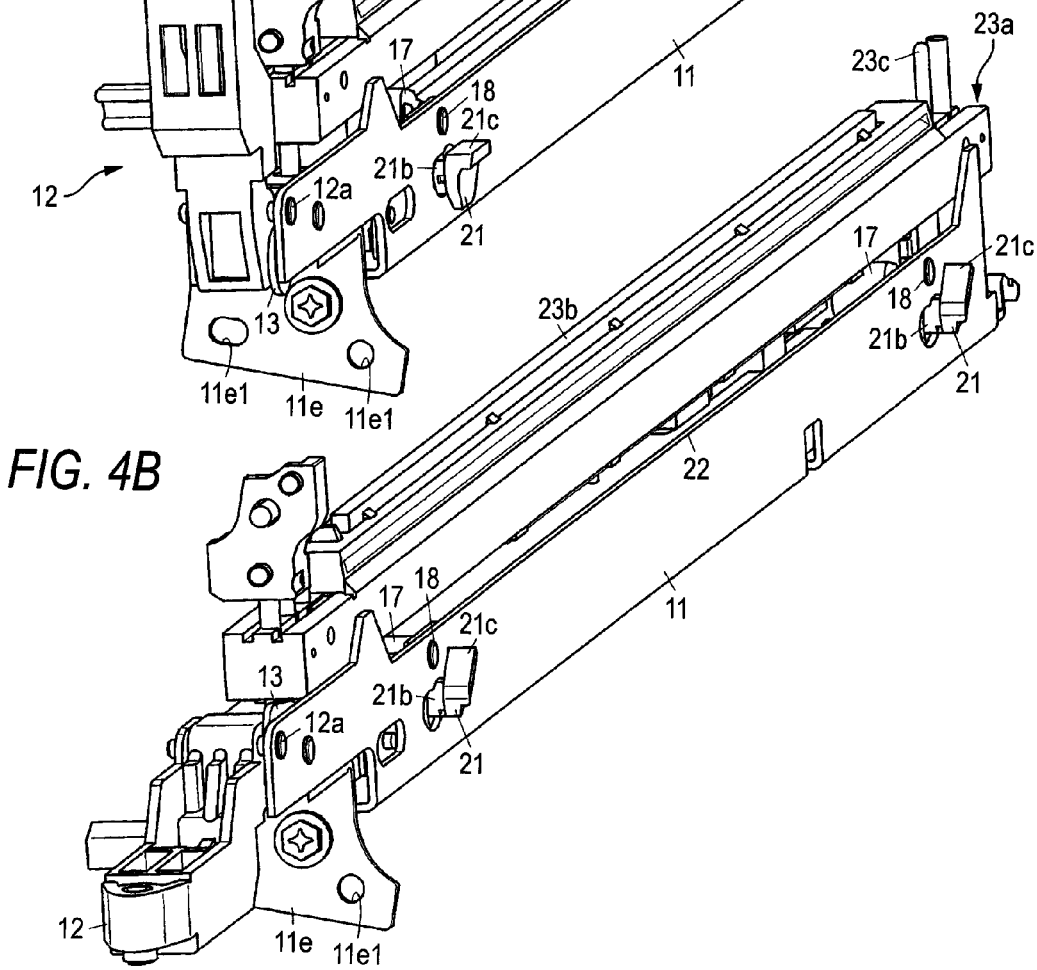
FIG. 4B is a schematic drawing to show a state in which the latent image-forming unit moves to a latent image-forming unit separation position.

FIG. 4 is perspective schematic drawings of the latent image-forming unit of the first embodiment of the invention; FIG. 4A is a schematic drawing to show a state in which the latent image-forming unit moves to the latent image-forming unit approach position; and FIG. 4B is a schematic drawing to show a state in which the latent image-forming unit moves to the latent image-forming unit separation position.

Figure 5A:
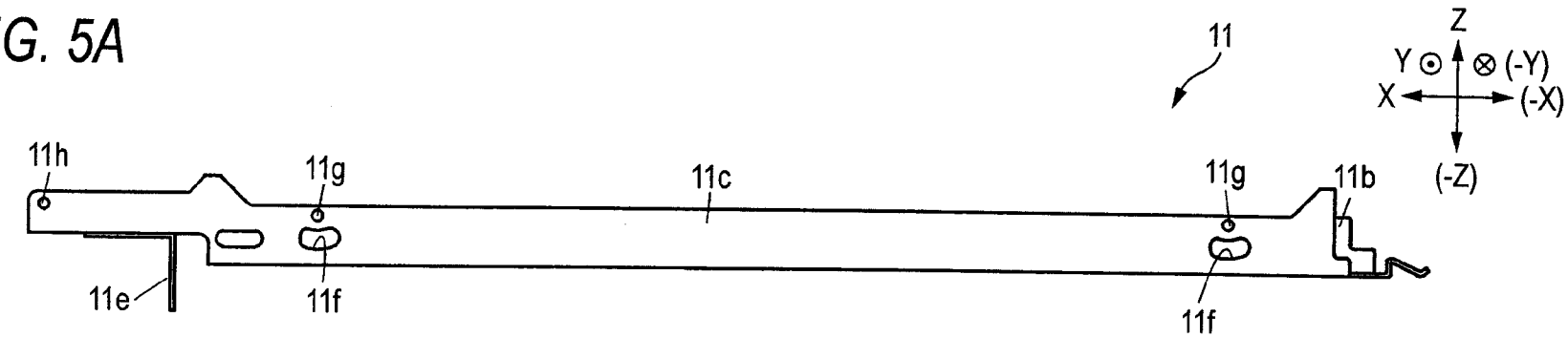
FIG. 5A is a plan view.
Figure 5B:
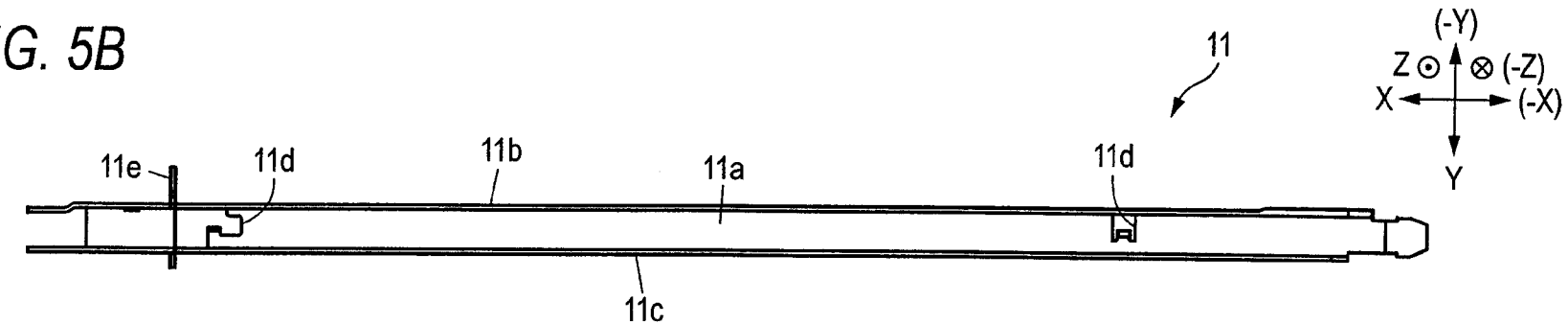
FIG. 5B is a side view.

FIG. 5 is a schematic drawing of an outer frame of the latent image-forming unit of the first embodiment of the invention; FIG. 5A is a plan view; and FIG. 5B is a side view.

In FIG. 4, the latent image-forming unit LHy of the first embodiment has an outer frame 11 fixedly supported by screws to the image-forming apparatus main body U2. In FIG. 5, the outer frame 11 has a bottom wall 11*a* extending in a back and forth direction of an axial direction of the image carrier PRy and a left wall 11*b* and a right wall 11*c* extending upward from both left and right ends of the bottom wall 11*a*. A pair of urging member one end support parts 11*d* each shaped like a hole is formed at both back and forth ends of the bottom wall 11*a*.

In FIGS. 4 and 5, a fixed part 11*e* extending downward is formed on the lower face of the front part of the left wall 11*b* and the right wall 11*c*, and is screwed into the image-forming apparatus main body U2 through holes 11*e*1 made in the fixed part 11*e*. A pair of back and forth through parts 11*f* at the out side of the interlocking contact member is made in the right wall 11*c*, and each of the through parts 11*f* of the first embodiment is formed as a long hole shaped like a circular arc. A pair of back and forth rotation shaft support parts 11*g* is formed above the through parts 11*f*. A pair of left and right rotation support parts 11*f* for the operation member is made in the front ends of the left wall 11*b* and the right wall 11*c*, and each of the rotation support parts 11*h* of the first embodiment is formed as a through hole.

Figure 6A:
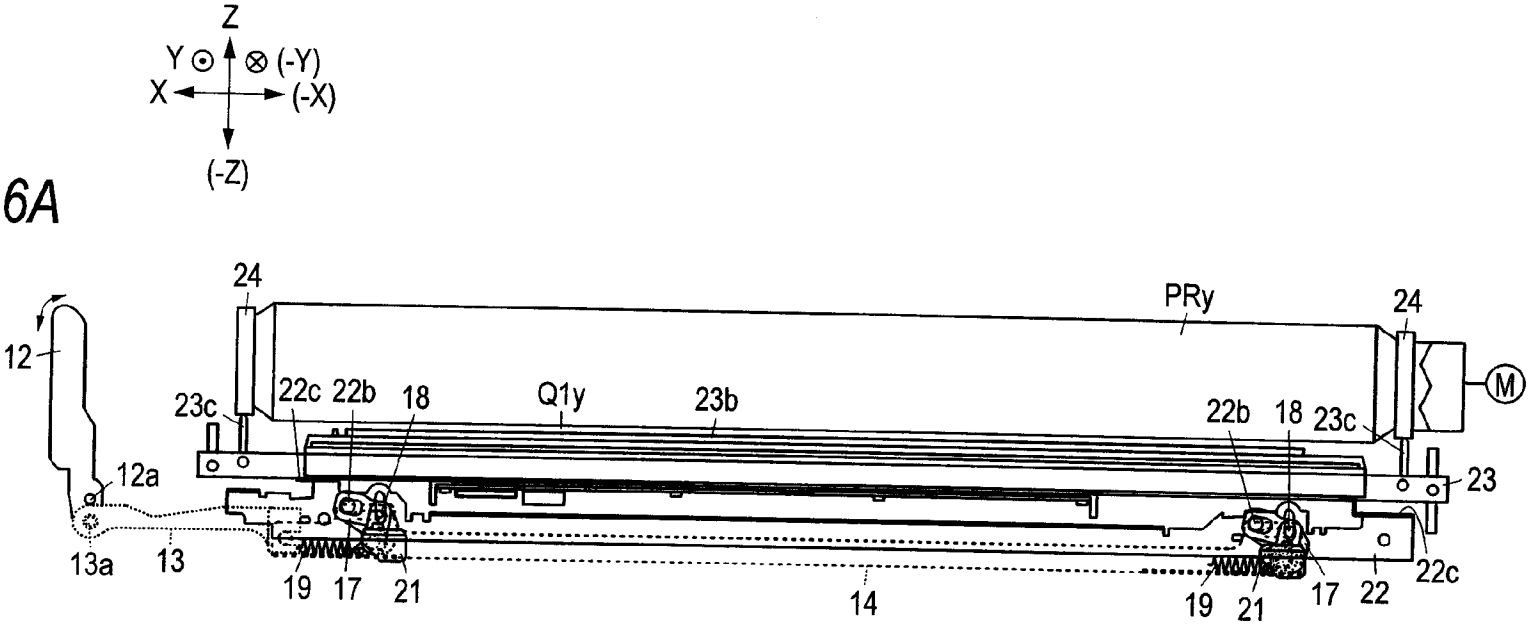
FIG. 6A is a schematic drawing to show a state in which the latent image-forming unit moves to a latent image-forming unit approach position.
Figure 6B:
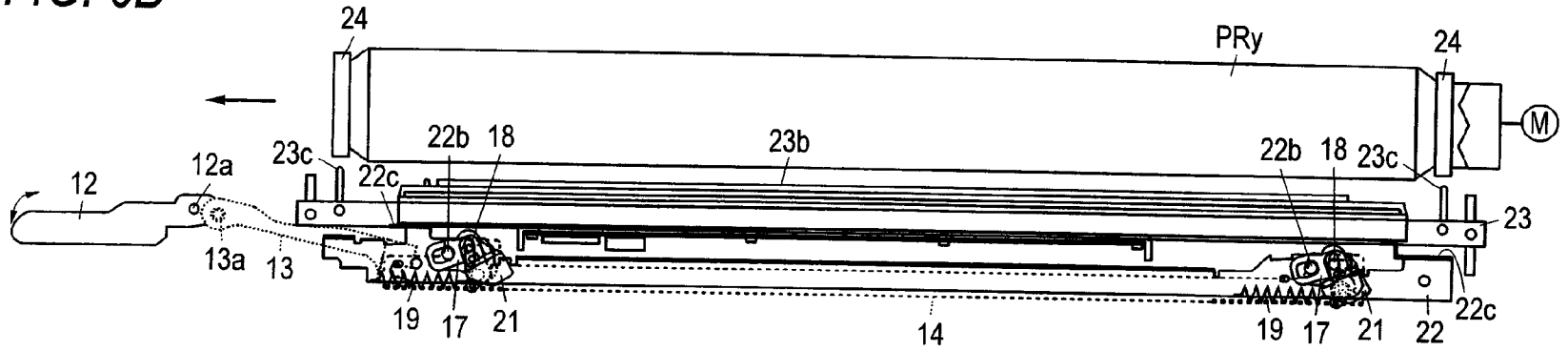
FIG. 6B is a schematic drawing to show a state in which the latent image-forming unit moves to a latent image-forming unit separation position.

FIG. 6 is schematic drawings to describe the positional relationship between the latent image-forming unit and the image carrier of the first embodiment of the invention; FIG. 6A is a schematic drawing to show a state in which the latent image-forming unit moves to the latent image-forming unit approach position; and FIG. 6B is a schematic drawing to show a state in which the latent image-forming unit moves to the latent image-forming unit separation position.

Figure 7A:
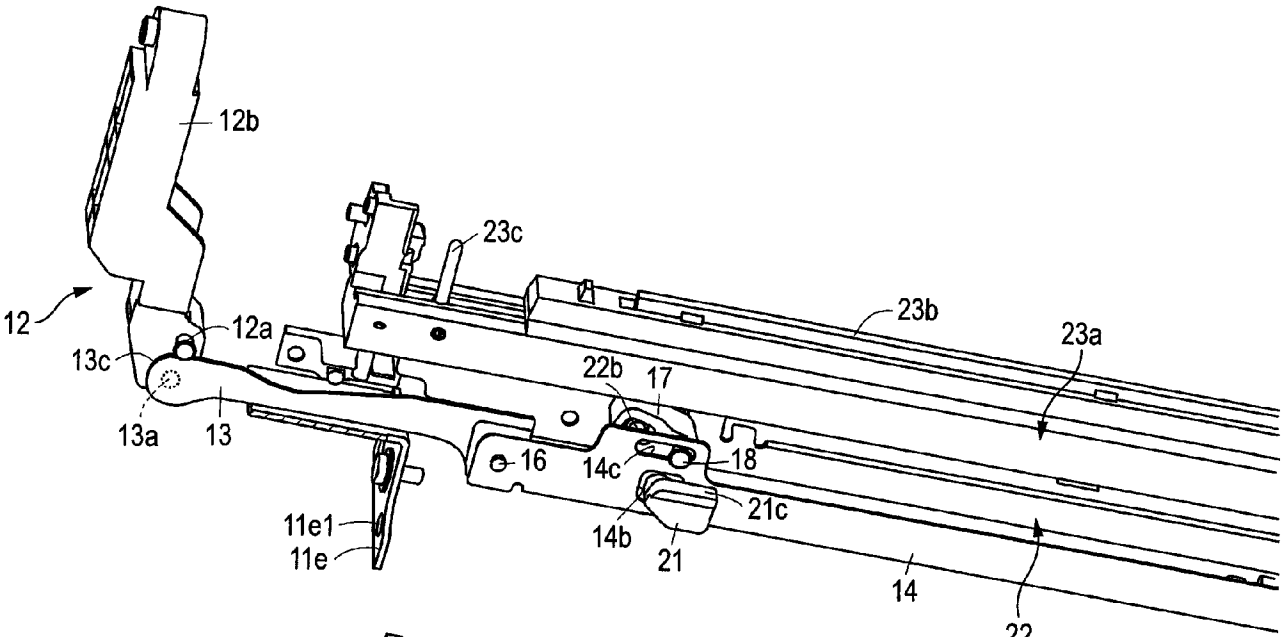
FIG. 7A is a schematic drawing to show a state in which the latent image-forming unit moves to the latent image-forming unit approach position.
Figure 7B:
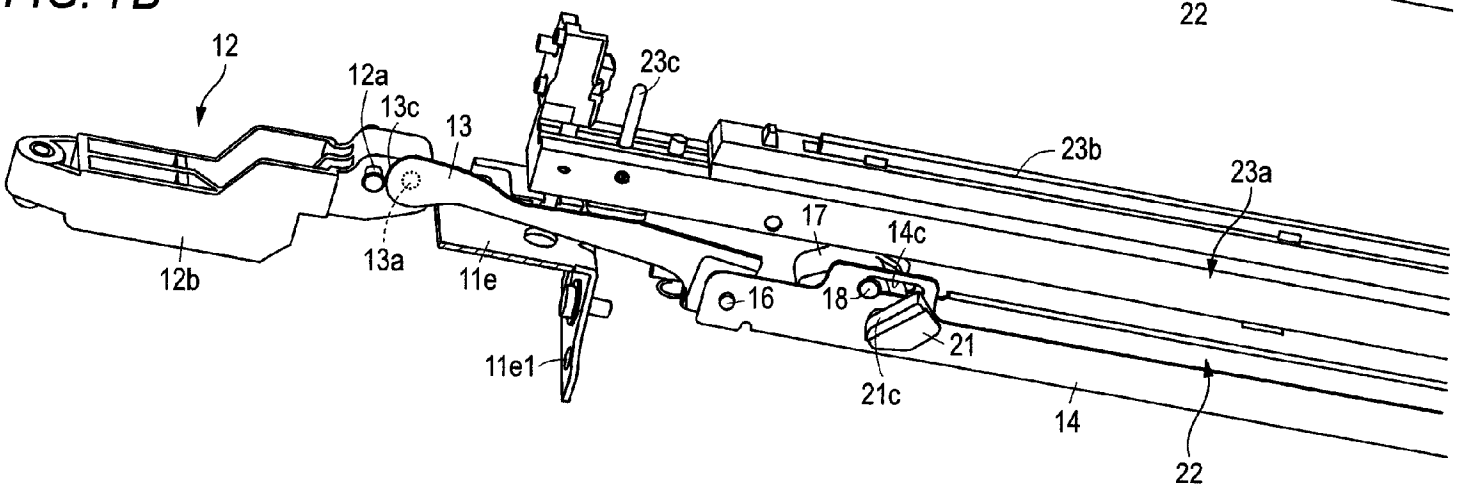
FIG. 7B is a schematic drawing to show a state in which the latent image-forming unit moves to the latent image-forming separation position.

FIG. 7 is a schematic drawing of the main part of an approach and separation mechanism of the latent image-forming unit of the first embodiment of the invention in a state in which a part of the outer frame is not shown from the state shown in FIG. 4; FIG. 7A is a schematic drawing to show a state in which the latent image-forming unit moves to the latent image-forming unit approach position; and FIG. 7B is a schematic drawing to show a state in which the latent image-forming unit moves to the latent image-forming unit separation position.

In FIGS. 4 and 7, an operation member 12 is supported on the operation member rotation support parts 11*h* of the outer frame 11 for rotation on a rotation shaft member 12*a*. The operation member 12 has a grip part 12*b* grasped by the user for operation. It is supported so that it can move between a usual position at which it rotates upward as shown in FIGS. 4A, 6A, and 7A and an insertable and removable position at which it rotates forward shown in FIGS. 4B, 6B, and 7B as the user grasps and operates the grip part 12*b*. As shown in FIG. 6A, in the first embodiment, the operation member 12 is placed ahead in the axial direction of the image carrier PRy at the usual position and is adapted to restrict a movement of the image carrier PRy in the axial direction, namely, attachment and detachment of the image carrier PRy to and from the image-forming apparatus main body U2.

Figure 8A:
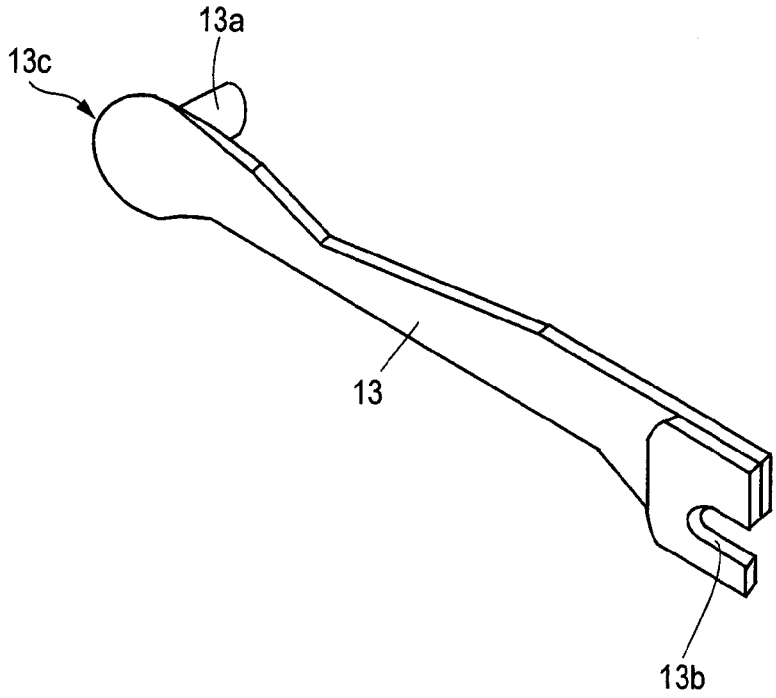
FIG. 8A is a perspective view.
Figure 8B:
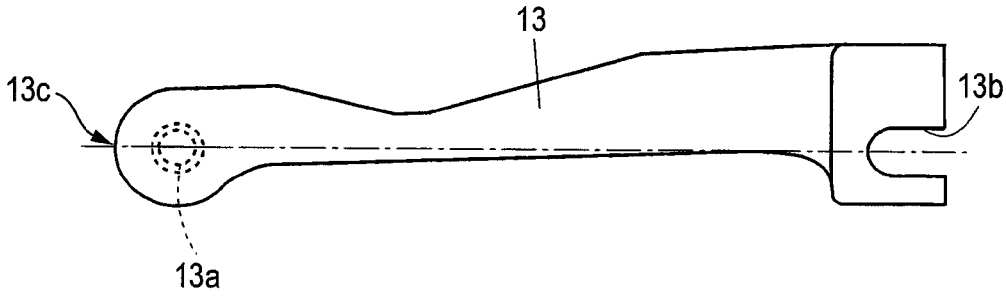
FIG. 8B is a side view.

FIG. 8 is a schematic drawing of an operation joint member of the latent image-forming unit of the first embodiment of the invention; FIG. 8A is a perspective view; and FIG. 8B is a side view.

In FIG. 4, an operation joint member 13 for coming in contact with the rotation shaft member 12*a* is placed between the right wall 11*c* of the outer frame 11 and the operation member 12. In FIGS. 7 and 8, the operation joint member 13 is implemented as a joint arm extending in the back and forth direction, and is formed at the front end with a rotation supported part 13*a* supported on the operation member 12 for rotation. In FIG. 8, a shaft joint concave part 13*b* shaped like a concave is formed at the rear end of the operation joint member 13. A dead point 13*c* is set on the extension of an imaginary line connecting the center of the circular arc of the circular arc portion of the shaft joint concave part 13*b* and the center of the rotation supported part 13*a*. As shown in FIGS. 6 and 7, while the operation member 12 moves between the usual position and the insertable and removable position, the rotation shaft member 12*a* of the operation member 12 is set so as to pass through the position where the dead point 13*c*, namely, the center of the circular arc of the circular arc portion of the shaft joint concave part 13*b* and the center of the rotation supported part 13*a* and the center of the rotation shaft member 12*a* are arranged in line.

Figure 9A:
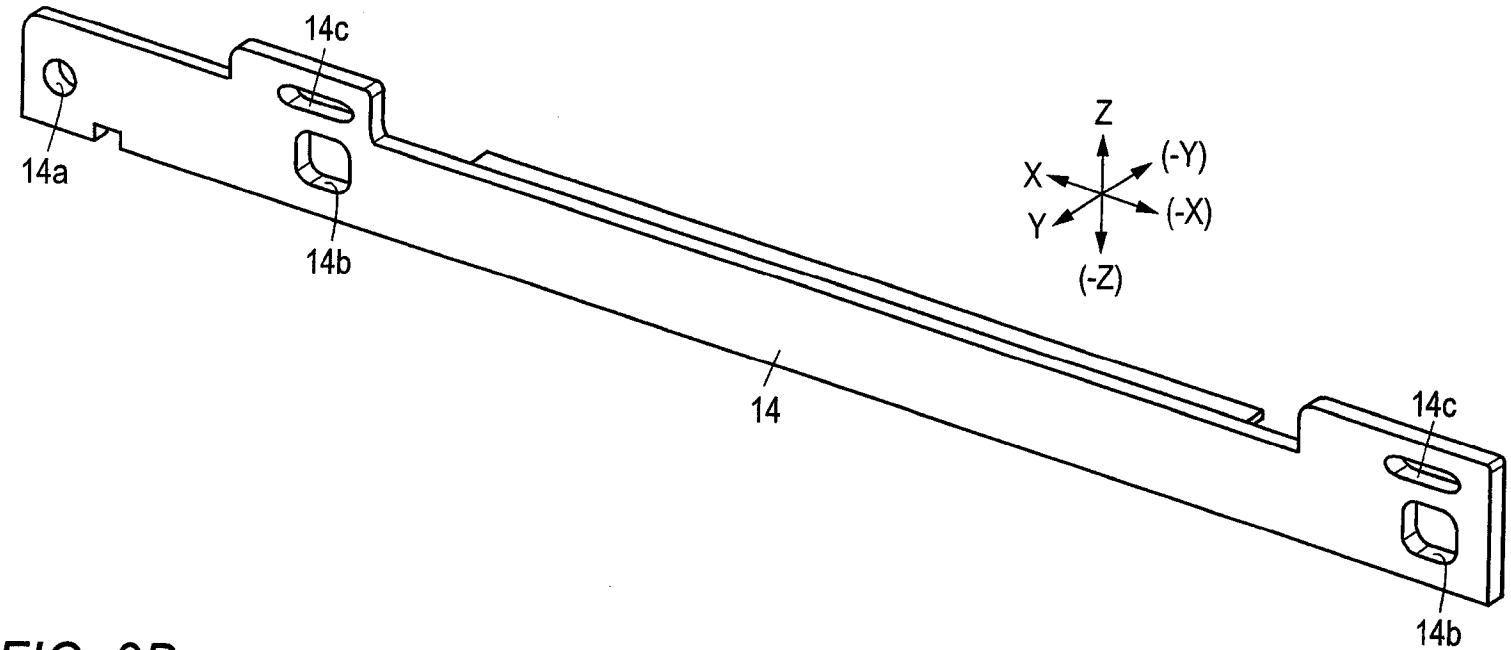
FIG. 9A is a perspective view.
Figure 9B:
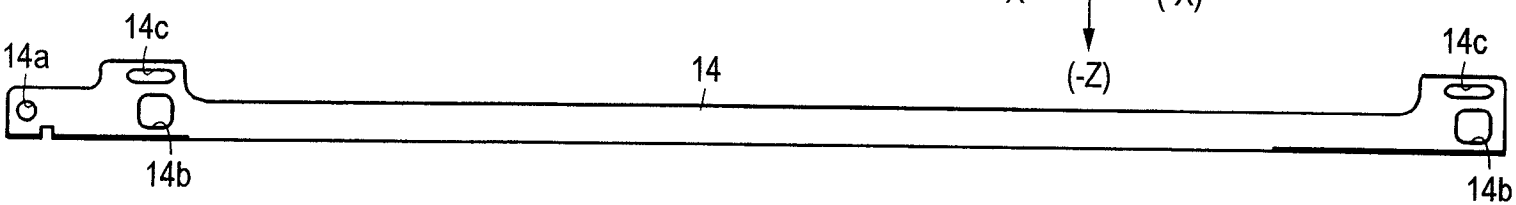
FIG. 9B is a side view.

FIG. 9 is a schematic drawing of a movement member of the latent image-forming unit of the first embodiment of the invention; FIG. 9A is a perspective view; and FIG. 9B is a side view.

In FIGS. 7 and 8, a movement member 14 is placed on the rear end side of the operation joint member 13. The movement member 14 is housed in the outer frame 11 and is supported so that it can move in the back and forth direction. The movement member 14 is formed at the front end with a shaft support part 14*a* corresponding to the shaft joint concave part 13*b* of the operation joint member 13. A joint shaft 16 shown in FIG. 7 is supported on the shaft support part 14*a* and is fitted into the shaft joint concave part 13*b* for joint.

In FIGS. 7 and 9, the movement member 14 is formed with a pair of back and forth though parts 14*b* at the inside of the interlocking contact member, each made as a square hole corresponding to the through parts 11*f* of the outer frame 11. Formed above the through parts 14*b* is a pair of back and forth through parts 14*c* of the rotation shaft for direction conversion, each made as a long hole in the back and forth direction corresponding to the rotation shaft support parts 11*g*.

Figure 10:
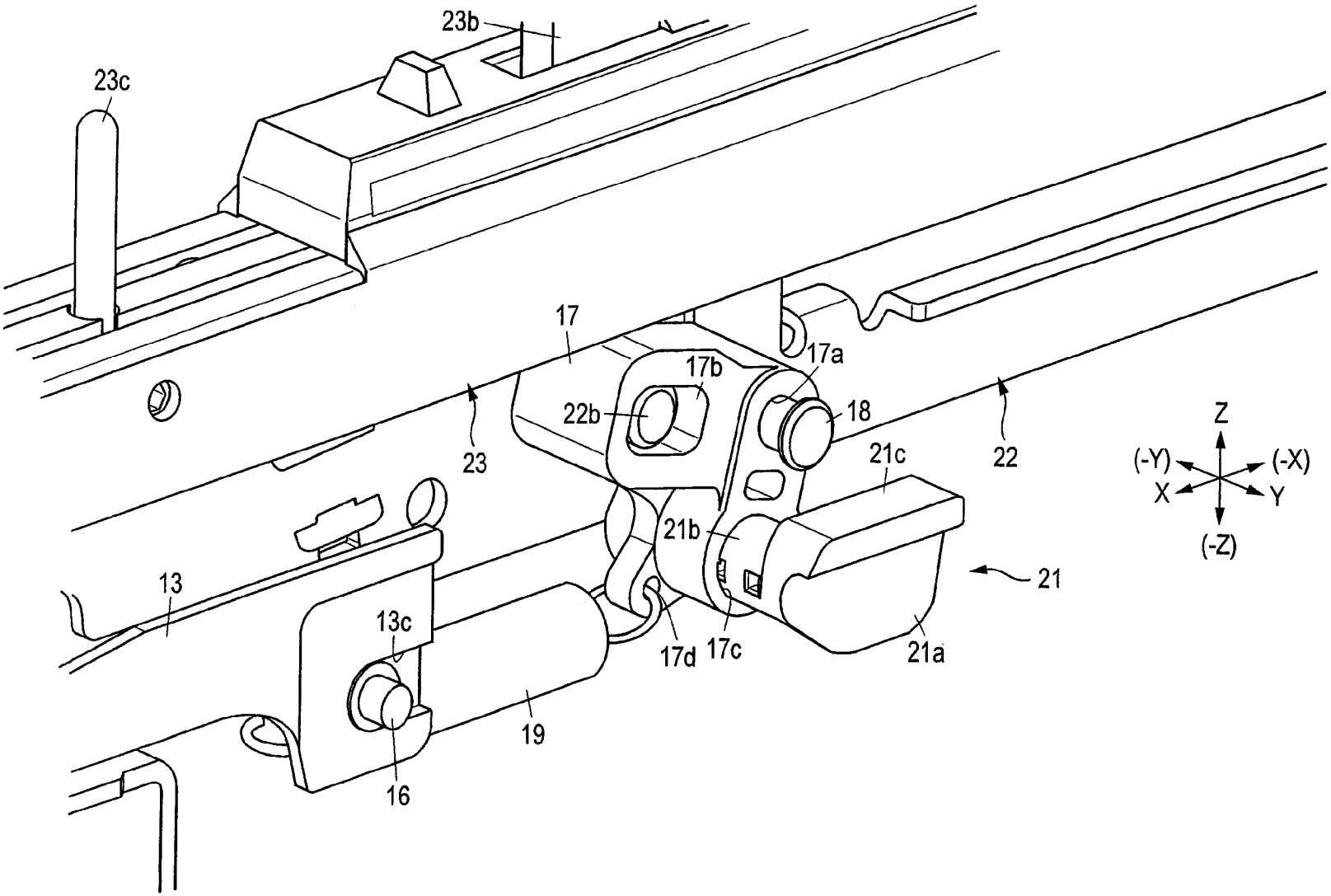
FIG. 10 is an enlarged drawing of the main part of an interlocking contact member of the latent image-forming unit of the first embodiment of the invention.

FIG. 10 is an enlarged drawing of the main part of an interlocking contact member of the latent image-forming unit of the first embodiment of the invention.

Figure 11A:
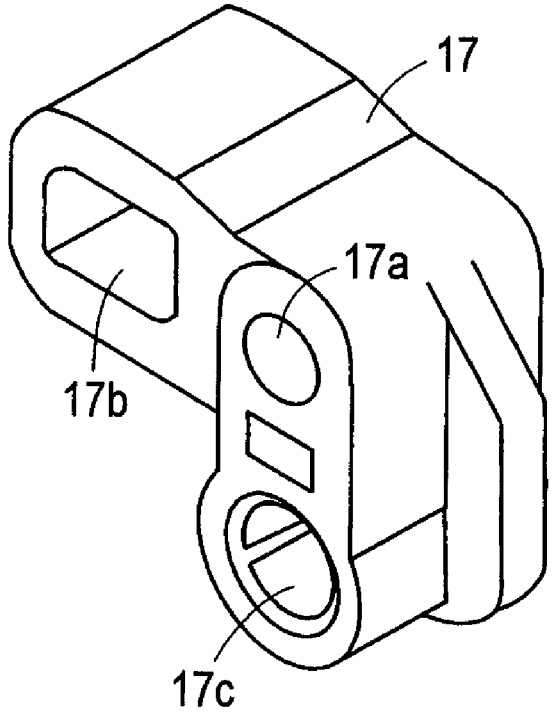
FIG. 11A is a perspective view.
Figure 11B:
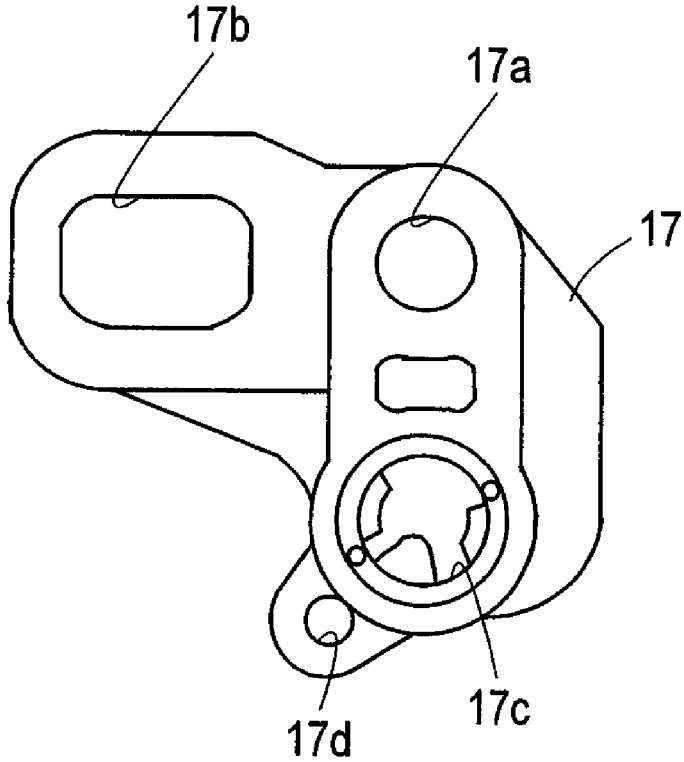
FIG. 11B is a side view.

FIG. 11 is a schematic drawing of a movement direction conversion member of the latent image-forming unit of the first embodiment of the invention; FIG. 11A is a perspective view; and FIG. 11B is a side view.

In FIG. 7, placed inside the movement member 14 is a pair of back and forth movement direction conversion members 17 corresponding to the through parts 14*c*. Each of the movement direction conversion members 17 is formed in the rear top part with a support part 17*a* of the rotation shaft for direction conversion and the support part 17*a* is supported by a rotation shaft 18 for direction conversion, piercing the through parts 14*c*, each made as a long hole and supported on the rotation shaft support parts 11*g* of the outer frame 11 for rotation. That is, the movement direction conversion member 17 is supported for rotation on the direction conversion rotation shaft 18 relative to the outer frame 11. In the embodiment, when the movement member 14 makes a relative move to the outer frame 11 in the back and forth direction, the direction conversion rotation shaft 18 pierces the through parts 14*c* each made as a long hole, so that the direction conversion rotation shaft 18 and the through parts 14*c* restrict the movement range of the movement member 14 as shown in FIG. 7.

In FIGS. 10 and 11, the movement direction conversion member 17 is formed in the front top part with an approach and separation member joint part 17*b* made as a long hole in the back and forth direction and is formed in the rear bottom part with a support part 17*c* for the interlocking contact member. An urging member opposite end support part 17*d* is formed below the slanting front of the support part 17*c*. In FIGS. 5 and 10, an urging spring 19 as an example of a latent image-forming unit urging member is placed between the support part 11*d* of the outer frame for supporting the urging member at one end and the support part 17*d* for supporting the urging member at the other end. The urging spring 19 produces a force of pulling the urging member opposite end support part 17*d* toward the support part 11*d* at all times. That is, the urging spring 19 urges the movement direction conversion member 17 in a direction in which the joint part 17*b* for the approach and separation member rotates upward on the direction conversion rotation shaft 18.

Figure 12A:
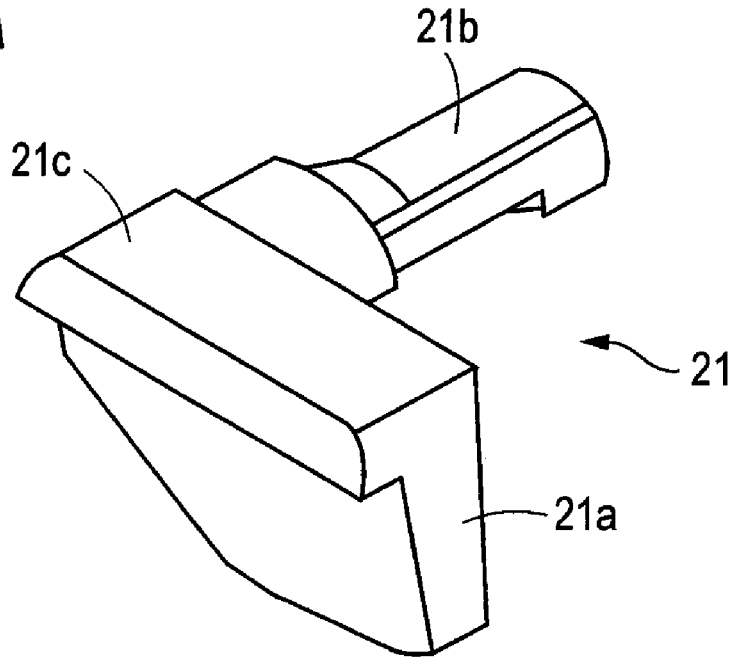
FIG. 12A is a perspective view.
Figure 12B:
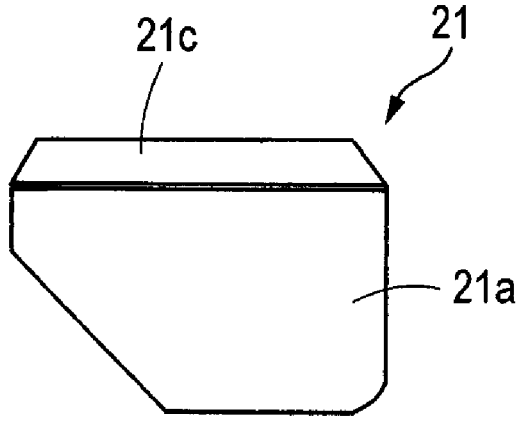
FIG. 12B is a side view.

FIG. 12 is schematic drawings of an interlocking contact member provided in the latent image-forming unit of the first embodiment of the invention; FIG. 12A is a perspective view; and FIG. 12B is a side view.

In FIGS. 7 and 10, an interlocking contact member 21 is provided on the support part 17*c* of the movement direction conversion member 17. In FIG. 12, the interlocking contact member 21 has a contact member main body 21*a* shaped like a trapezoid, a supported part 21*b* extending backward from the rear of the contact member main body 21*a*, and an interlocking contact part 21*c* formed on the top of the contact member main body 21*a* integrally with the contact member main body 21*a*. The supported part 21*b* pierces the interlocking contact member outside through part 11*f* of the outer frame 11 and the interlocking contact member inside through part 14*b* of the movement member 14 and is placed in the interlocking contact member support part 17*c* in an unrotatable state. Therefore, the interlocking contact member 21 is configured so that it can rotate with the movement direction conversion member 17 in one piece. In the first embodiment, the supported part 21*b* is formed like a rotation shaft and pierces the through part 11*f* and the through part 14*b* in a state in which it has a diameter formed smaller than that of each of the through part 11*f* and the through part 14*b* and is provided with play.

Therefore, if the through part 14*b* and the supported part 21*b* come in contact with each other with a movement of the movement member 14 and further the movement member 14 moves, the joint part 17*b* of the movement direction conversion member 17 rotates downward against the urging force of the urging spring 19. In the usual state, the supported part 21*b* rotating in one piece with the movement direction conversion member 17 by the urging force of the urging spring 19 pushes the through part 14*b* forward and thus the joint shaft 16 moves to the side of the shaft joint concave part 13*b* and joint of the operation joint member 13 and the movement member 14 is kept.

In FIG. 3A, the contact member main body 21*a* and the interlocking contact part 21*c* of the interlocking contact member 21 are placed on the developing device Gy side on the outside of the outer frame 11, and the interlocking contact part 21*c* is placed below the interlocking contacted member 8 extending from the developing device Gy.

The interlocking contact member 21 and the interlocking contacted member 8 make up an interlocking mechanism (8+2) of the first embodiment.

Figures 13A, 13B, 13C:
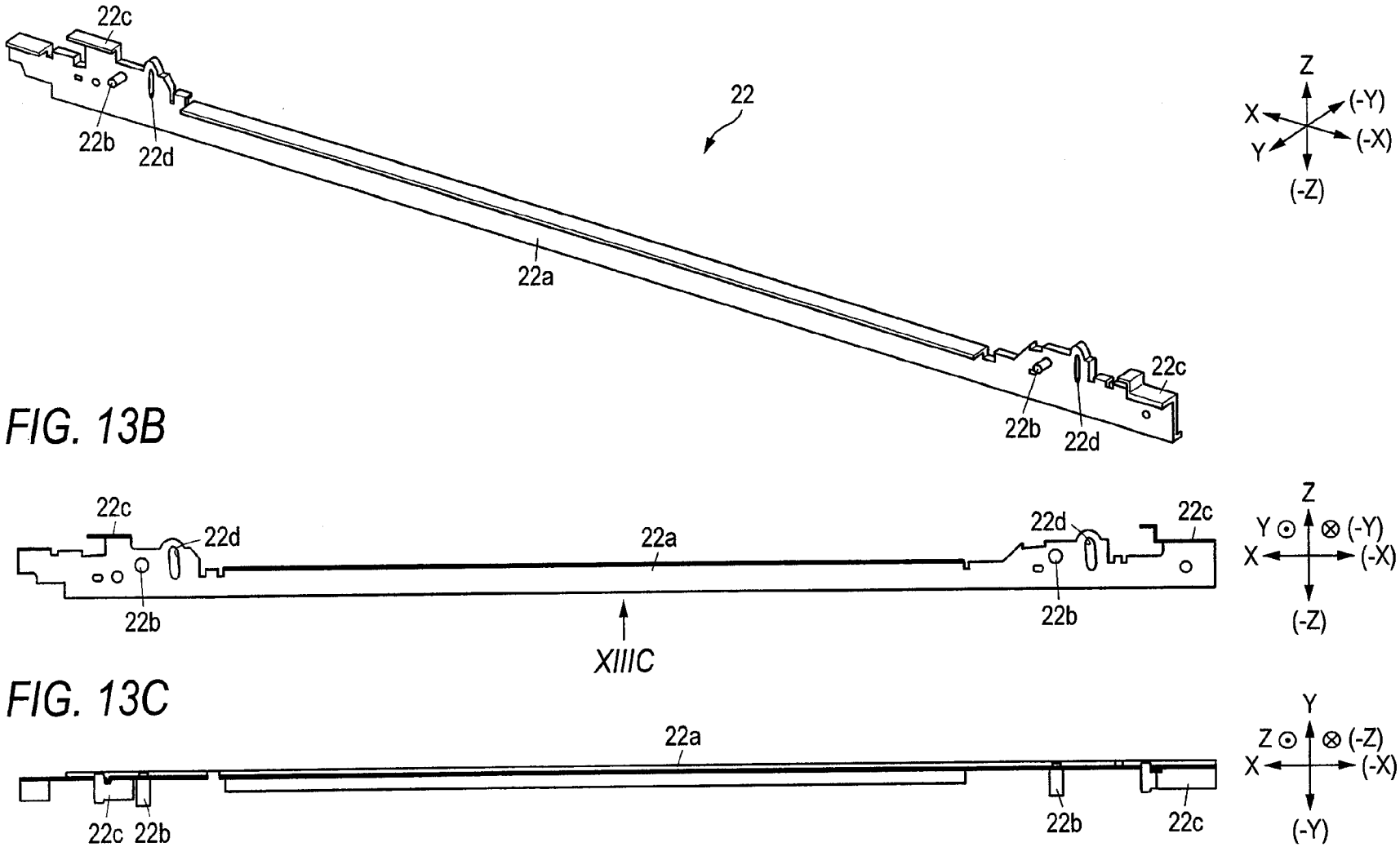
FIG. 13A is a perspective view.
FIG. 13B is a side view.
FIG. 13C is a plan view.

FIG. 13 is schematic drawings of an approach and separation member of the latent image-forming unit of the first embodiment of the invention; FIG. 13A is a perspective view; FIG. 13B is a side view, and FIG. 13C is a plan view.

In FIGS. 7 and 10, an approach and separation member 22 is placed on the left of the movement direction conversion member 17. In FIG. 13, the approach and separation member 22 has an approach and separation member main body 22*a* extending in the back and forth direction. At both back and forth ends of the approach and separation member main body 22*a*, joint members 22*b* projecting to the movement direction conversion member 17 side are supported at positions corresponding to the joint parts 17*b* of the movement direction conversion member 17. The joint member 22*b* is jointed to the joint part 17*b* formed as a long hole in a state in which it is fitted into the joint part 17*b* with play. Therefore, if the surfaces of the joint part 17*b* and the joint member 22*b* come in contact with each other with rotation of the movement direction conversion member 17, the approach and separation member 22 is pushed and moves in the up and down direction, namely, in the direction in which it approaches to or is separated from the image carrier PRy. Light irradiation unit-support parts 22*c* are formed on the tops of both back and forth ends of the approach and separation member 22. A pair of back and forth guide grooves 22*d* each made as a long hole extending in the up and down direction as guided parts of the up and down move of the relief hole and concurrently approach and separation member 22 of the direction conversion rotation shaft 18 is formed behind the joint members 22*b*.

Figure 14A:
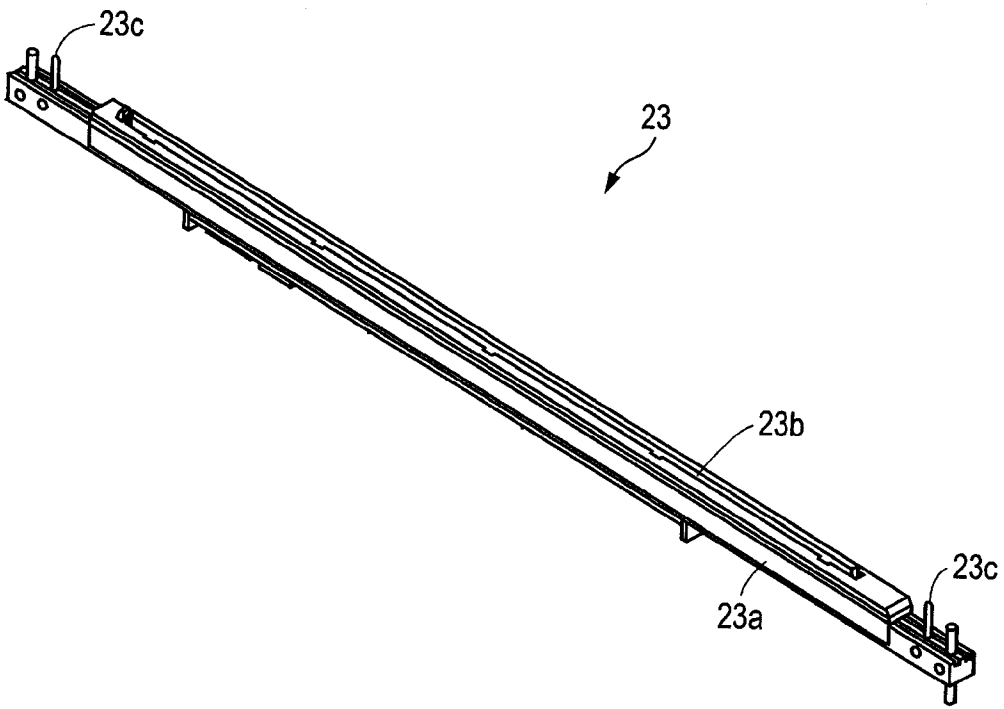
FIG. 14A is a perspective view.
Figure 14B:
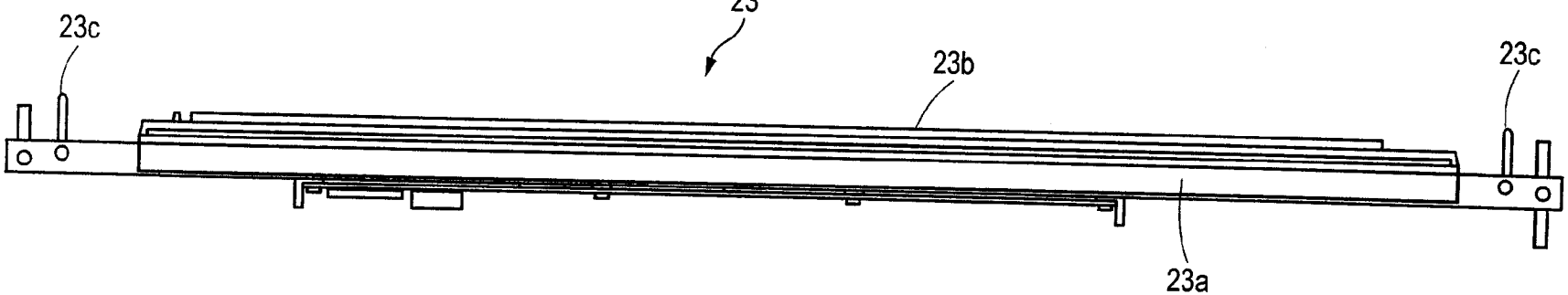
FIG. 14B is a side view.

FIG. 14 is schematic drawings of an image-writing light irradiation unit of the latent image-forming unit of the first embodiment of the invention; FIG. 14A is a perspective view; and FIG. 14B is a side view.

In FIGS. 7 and 10, an irradiation unit 23 for image-writing light is supported on the light irradiation unit-support parts 22*c* of the approach and separation member 22. The image-writing light irradiation unit 23 has an irradiation unit main body 23*a* extending in the back and forth direction and a light irradiation part 23*b*, as an example of an light-emitting surface for irradiating latent-image-writing light, supported on the irradiation unit main body 23*a* and placed facing the image carrier PRy. In the first embodiment, the irradiation unit main body 23*a* and a light source for forming a latent image on the surface of the image carrier PRy are placed side by side in the axial direction of the image carrier PRy, namely, in the main scanning direction, and the irradiation unit main body 23*a* is implemented as an LED array. In FIGS. 6 and 14, abutment parts 23*c* projecting upward are formed at both back and forth ends of the irradiation unit main body 23*a* and are abutted against bearing members 24 placed at both ends of the image carrier PRy at the latent image-forming unit approach position. Accordingly, at the latent image-forming unit approach position shown in FIG. 6A, the spacing between the light irradiation part 23*b* and the surface of the image carrier PRy is kept in a spacing and the focal point of latent-image-writing light irradiated from the light irradiation part 23*b* is precisely kept so as to become the surface of the image carrier PRy.

The outer frame 11, the operation member 12, the operation joint member 13, the movement member 14, the shafts 16 and 18, the movement direction conversion member 17, the urging spring 19, the supported part 21*b*, the approach and separation member 22, and the like make up an approach and separation mechanism (11 to 22) for the latent image-forming unit.

(Description of Developer Replenishment Units)

Figure 15:
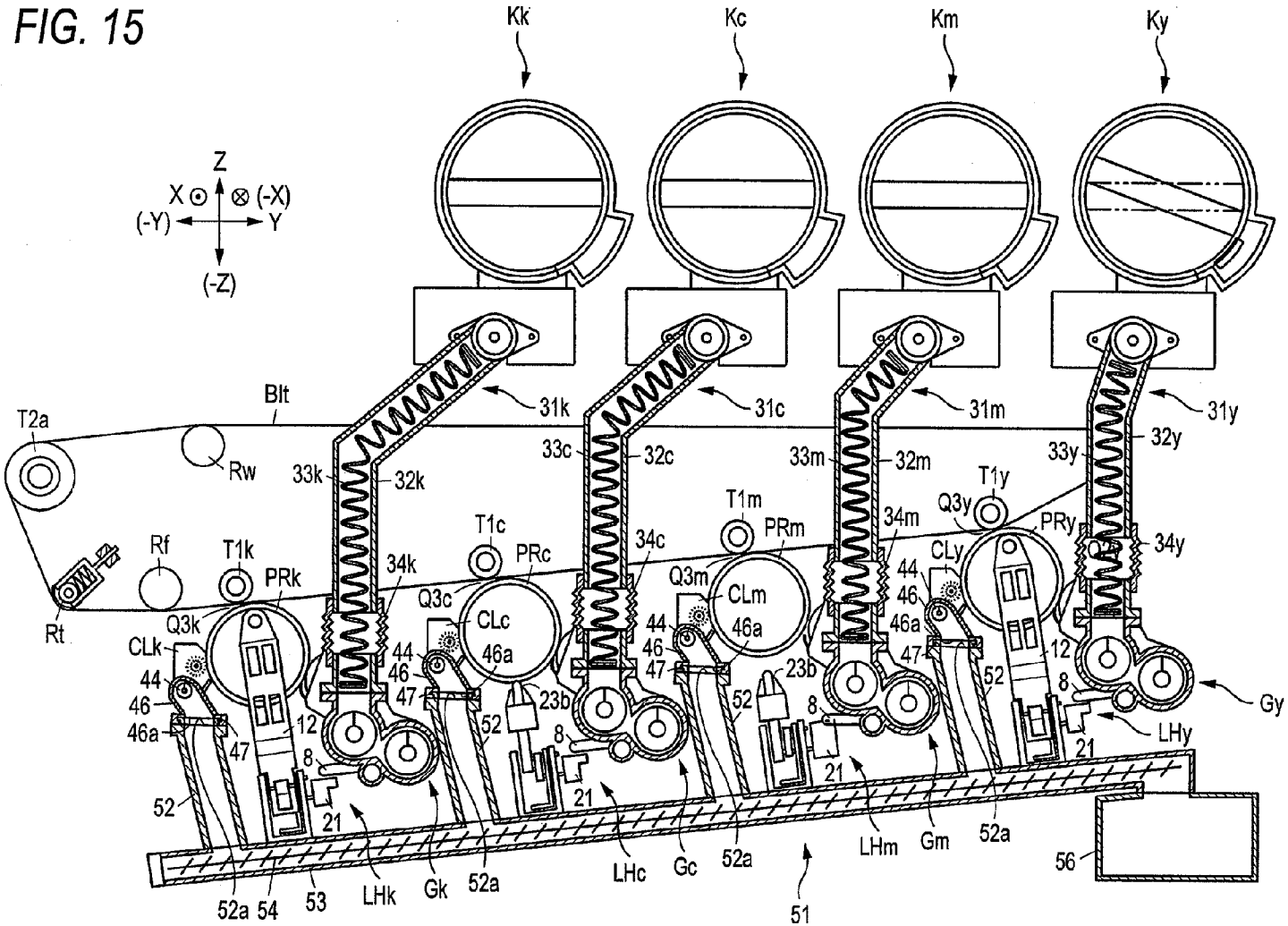
FIG. 15 is a schematic drawing of developer replenishment units and residue collectors of the first embodiment of the invention.

FIG. 15 is a schematic drawing of developer replenishment units and residue collectors of the first embodiment of the invention.

In FIG. 15, for example, the members such as the chargers CRy to CRk and the operation member 12 of magenta, cyan, etc., are not shown in the drawings where appropriate for easy understanding.

In FIGS. 1, 2, and 15, the developer cartridges Ky, Km, Kc, and Kk for storing replenishment developers are supported so that they can be attached to and detached from developer replenishment units 31*y*, 31*m*, 31*c*, and 31*k* for replacement. The developer replenishment units 31*y*, 31*m*, 31*c*, and 31*k* have developer replenishment passages 32*y*, 32*m*, 32*c*, and 32*k* extending from the developer cartridges Ky, Km, Kc, and Kk to the developing devices Gy, Gm, Gc, and Gk, wherein developers are transported. The developer replenishment passages 32*y*, 32*m*, 32*c*, and 32*k* are set so as to replenish the developing devices Gy, Gm, Gc, and Gk with developers on the front of the image-forming apparatus U. Developer replenishment members 33*y*, 33*m*, 33*c*, and 33*k* for rotating to transport the developers in the developer replenishment passages 32*y*, 32*m*, 32*c*, and 32*k* are placed in the developer replenishment passages 32*y*, 32*m*, 32*c*, and 32*k*. Bellows-shaped connection members 34*y*, 34*m*, 34*c*, and 34*k* for maintaining the connection state of the developer replenishment passages 32*y*, 32*m*, 32*c*, and 32*k* at the approach and separation times of the developing devices Gy, Gm, Gc, and Gk are placed at ends of the developer replenishment passages 32*y*, 32*m*, 32*c*, and 32*k* on the side of the developing devices Gy, Gm, Gc, and Gk.

(Description of Image Carrier Cleaners and Residue Collectors)

In FIGS. 1, 2, and 15, the image carrier cleaners CLy, CLm, CLc, and CLk have each a cleaning vessel. Residue removal members for coming in contact with the image carrier PRy, PRm, PRc, PRk to remove the residues of the residual developer, paper powder, etc., deposited on the surface of the image carrier PRy, PRm, PRc, PRk are placed in the cleaning vessel. In the embodiment, the cleaning vessel contains a cylindrical cleaning brush for coming in contact with the image carrier while rotating and a plate-like cleaning blade pressed against for the image carrier PRy, PRm, PRc, PRk for scraping the residues as examples of the residue removal members. In the embodiment, both the cylindrical cleaning brush and the cleaning blade are provided, but either of them can also be adopted; in addition, any desired known residue removal member such as a residue removal member made of cloth can be adopted.

The cleaning vessel also has a developer storage chamber (not shown) for storing the developer removed with the cleaning member and a residue transport member 44 for transporting the developer in the developer storage chamber is placed in the developer storage chamber.

Figure 16:
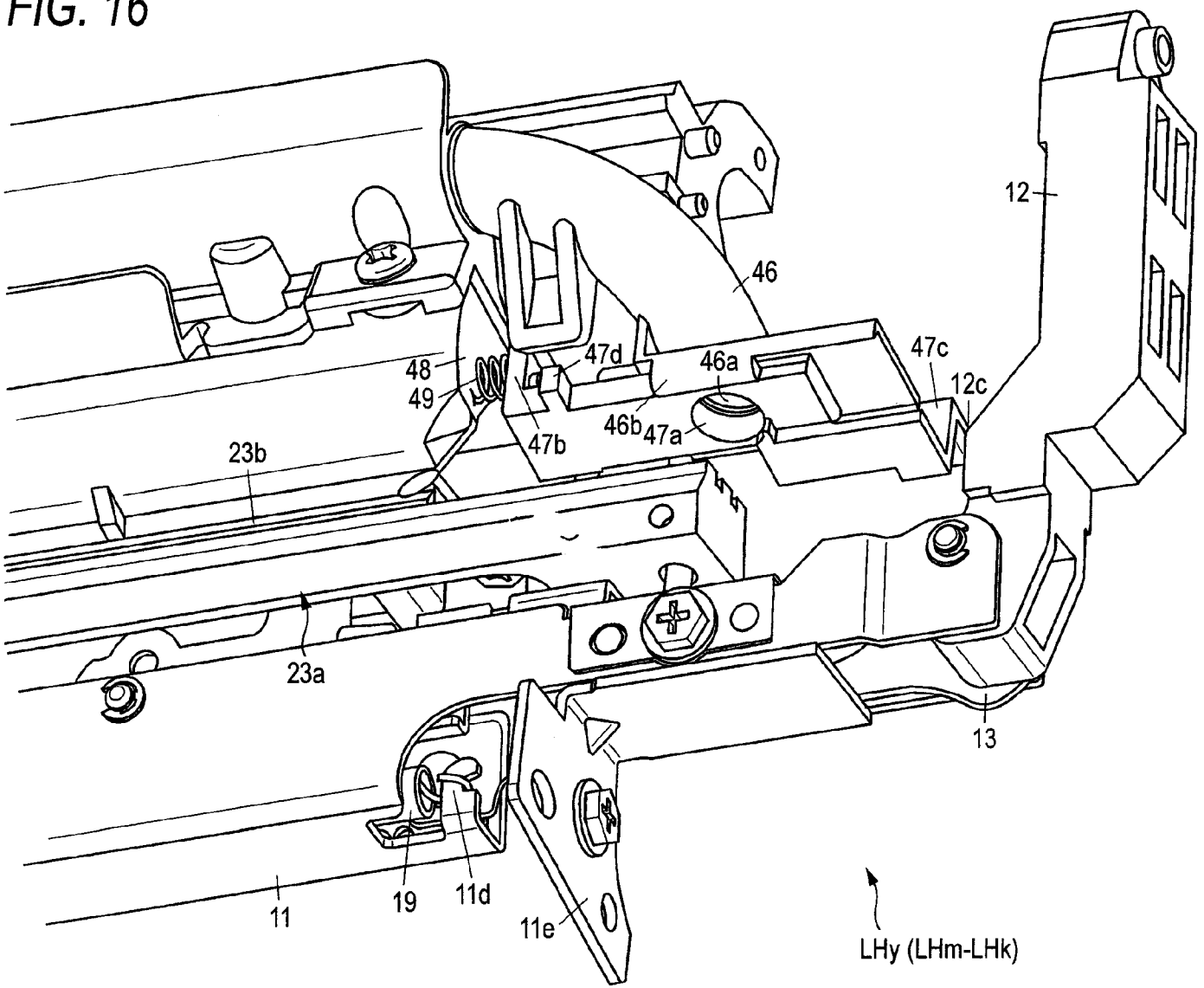
FIG. 16 is an enlarged perspective view of the main part of a residue ejection passage and a shield member of the first embodiment of the invention.

FIG. 16 is an enlarged perspective view of the main part of a residue ejection passage and a shield member of the first embodiment of the invention.

Figure 17:
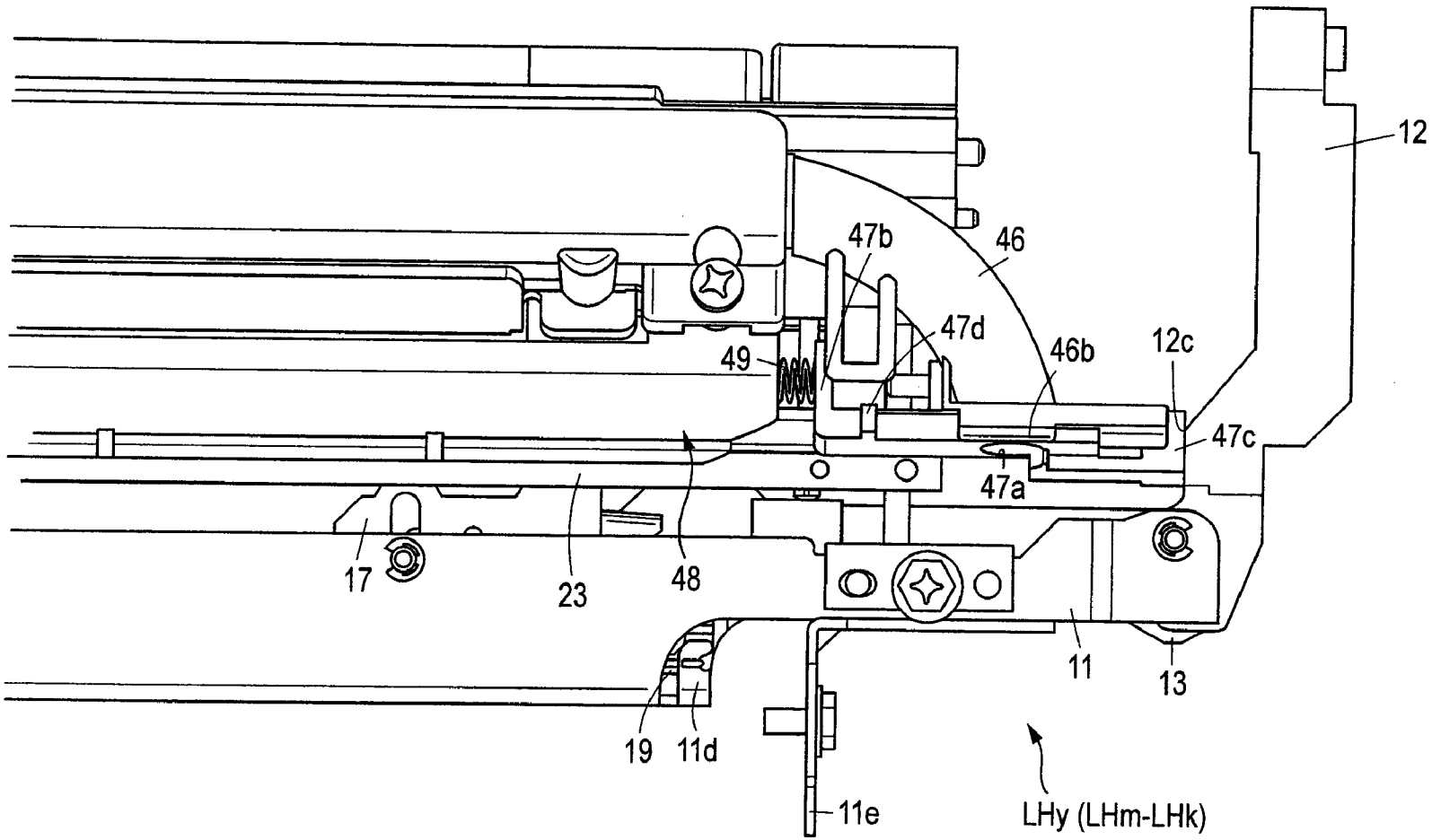
FIG. 17 is a side view of the main part of the residue ejection passage and the shield member of the first embodiment of the invention.

FIG. 17 is a side view of the main part of the residue ejection passage and the shield member of the first embodiment of the invention.

In FIGS. 15 to 17, a residue ejection passage 46 extending downward and connected to the inside of the cleaning vessel for ejecting the residue transported by the residue transport member 44 to the outside of the developer storage chamber is formed at the front end of the cleaning vessel. A residue ejection port 46*a* where the residue transported by the residue transport member 44 is ejected is formed at the lower end of the residue ejection passage 46. A shutter guide part 46*b* as an example of a shield member guide part is formed at the lower end of the residue ejection passage 46.

An ejection port shutter 47 as an example of a shield member is supported on the shutter guide part 46*b* so that it can shift in the back and forth direction. In FIGS. 16 and 17, the ejection port shutter 47 is formed with an opening 47*a* made corresponding to the residue ejection port 46*a*. The ejection port shutter 47 is formed at the rear end with a shield member urging member support part 47*b* shaped as it bends upward. A shutter move spring 49 as an example of an urging member for holding the ejection port shutter 47 at a shield position as an example of a movement regulation member is supported between the shield member urging member support part 47*b* and a frame 48 of the image carrier unit. The ejection port shutter 47 receives a forward move forth at all times from the shutter move spring 49.

The ejection port shutter 47 is formed at the front end with a shield member interlocking part 47*c* extending to the operation member 12. The shield member interlocking part 47*c* is adapted to be able to come in contact with an interlocking contact part 12*c* formed in the proximity of the rotation shaft member 12*a* of the operation member 12 of the latent image-forming unit LHy, LHm, LHc, LHk. The shield member interlocking part 47*c* and the interlocking contact part 12*c* make up an interlocking mechanism 12*c*+47*c* for the shield member of the first embodiment.

The ejection port shutter 47 is formed at the back with a slip out prevention part 47*d* formed like a projection projecting outward for coming in contact with the shutter guide part 46*b* to prevent the ejection port shutter 47 from slipping out.

In FIG. 15, a residue collector 51 fixed to and supported on the image-forming apparatus main body U2 is placed below the ejection port shutter 47. The residue collector 51 has a connection passage 52 extending toward the residue ejection port 46*a* and the connection passage 52 is formed at the upper end with a receiving port 52*a* that can be connected to and disconnected from the residue ejection port 46*a* through the ejection port shutter 47. The lower ends of the connection passages 52 placed in a one-to-one correspondence with the colors are connected to a common effluence transport passage 53 extending to the right. An ejected residue transport member 54 which is rotated is placed in the common effluence transport passage 53, and the developer in the common effluence transport passage 53 is transported to the right with rotation of the ejected residue transport member 54. A residue collection vessel 56 supported on the image-forming apparatus main body U2 detachably for replacement is provided at the right end of the common effluence transport passage 53 for collecting the residue transported by the ejected residue transport member 54.

Function of First Embodiment

In the image-forming apparatus U of the first embodiment described above, the movement member 14 is held forward through the movement direction conversion member 17 by the urging force of the urging spring 19 in a state in which the operation member 12 is moved to the upward usual position as shown in FIGS. 3A and 6A. Accordingly, the approach and separation member 22 is held upward and the light irradiation part 23*b* of the image-writing light irradiation unit 23 is held in a state in which it is placed with a spacing from the image carrier PRy. That is, the latent image-forming unit LHy having the members 12 to 23 is held at the latent image-forming unit approach position and enters a state in which it can form a latent image. The developing device Gy is held at the developing device approach position closely opposed to the image carrier PRy by the developing device urging member 7. At this time, the interlocking contact part 21*c* and the interlocking contacted member 8 are held in a separation state, vibration occurring due to rotation of the developer holding body 4 of the developing device Gy during the image formation operation is prevented from being transmitted to the latent image-forming unit LHy, and the latent image-forming unit LHy executes precise latent image formation.

Figure 18:
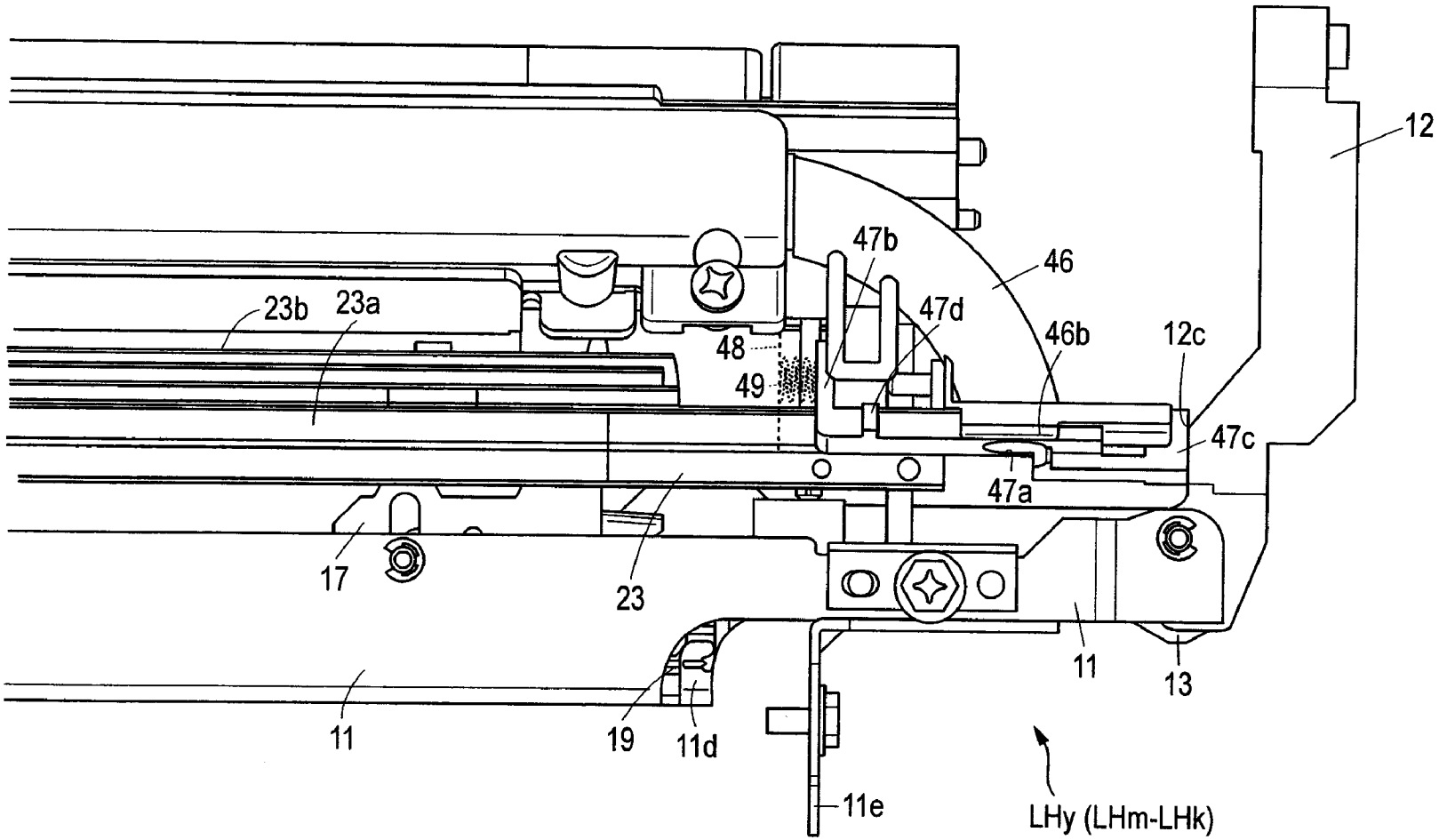
FIG. 18 is a schematic drawing of the function of the first embodiment of the invention and is a drawing to describe the positional relationship between the light-emitting surface of the latent image-forming unit at a usual position and a residue ejection port.

FIG. 18 is a schematic drawing of the function of the first embodiment of the invention and is a drawing to describe the positional relationship between the light-emitting surface of the latent image-forming unit at the usual position and the residue ejection port.

In FIG. 18, at the usual position for forming an image, the interlocking contact part 12*c* of the operation member 12 held at the usual position presses the shield member interlocking part 47*c* and the ejection port shutter 47 is held at an ejection position as the opening 47*a*, the residue ejection port 46*a*, and the receiving port 52*a* match and the residue ejection passage 46 and the connection passage 52 are connected. At this time, the light irradiation part 23*b* of the light-emitting surface is placed above in the gravity direction relative to the residue ejection port 46*a* as shown in the latent image-forming unit LHc of cyan C in FIGS. 18 and 15.

In this state, the residues removed from the surfaces of the image carriers PRy, PRm, PRc, and PRk at the image formation operation time are transported from the image carrier cleaners CLy, CLm, CLc, and CLk to the residue collection vessel 56 and are collected therein.

(Description of Separation Operation of Latent Image-forming Unit and Developing Device)

Figure 19A:
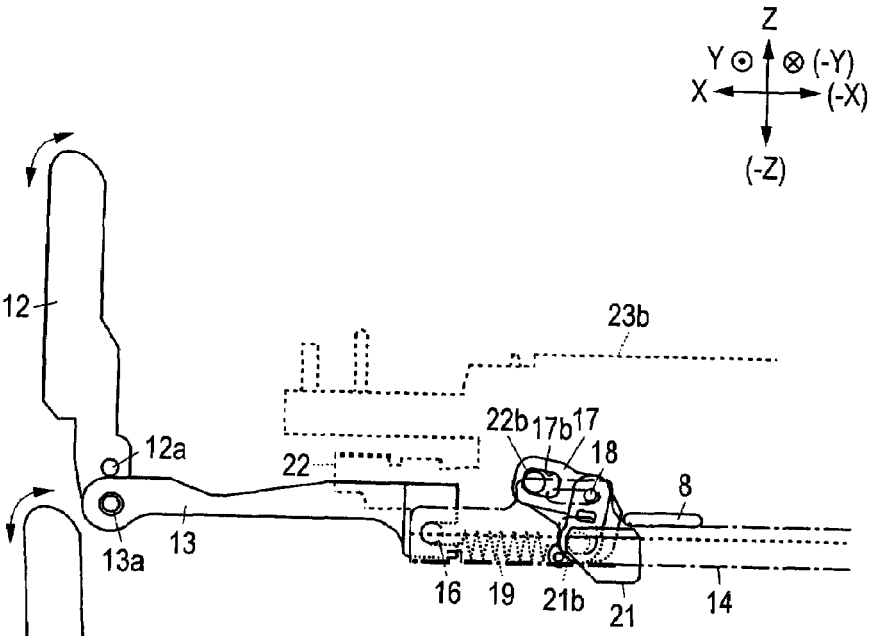
FIG. 19A is a schematic drawing to show a state just after an operation member starts to move from a usual position to an insertable and removable position.
Figure 19B:
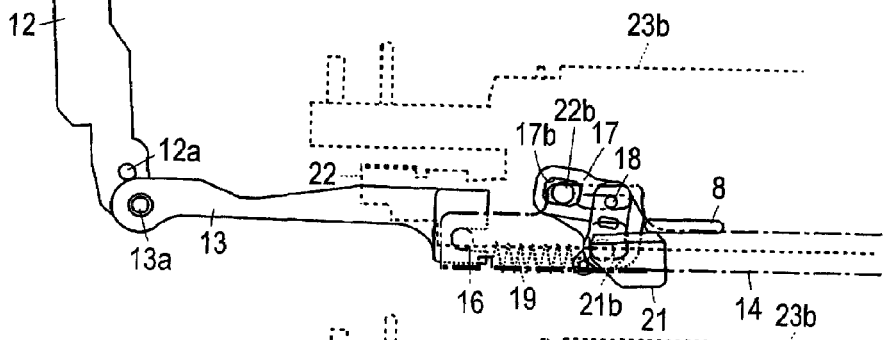
FIG. 19B is a schematic drawing to show a state in which the operation member further moves to the side of the insertable and removable position from the state shown in FIG. 19A.
Figure 19C:
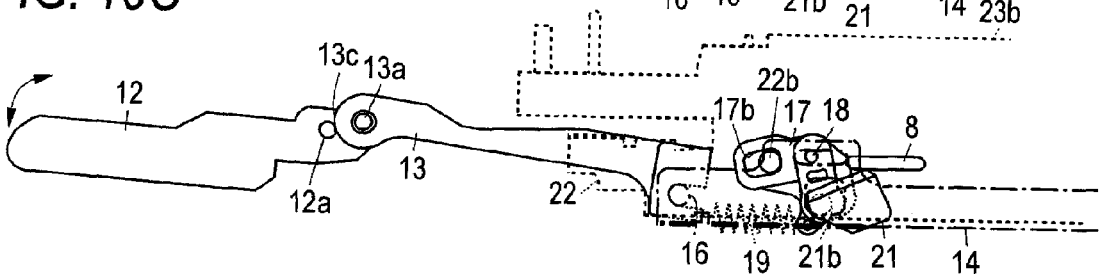
FIG. 19C is a schematic drawing to show a state in which the operation member reaches the insertable and removable position.

FIG. 19 is schematic drawings of the function when the latent image-forming unit and the developing device of the first embodiment of the invention are separated from the image carrier; FIG. 19A is a schematic drawing to show a state just after the operation member starts to move from the usual position to the insertable and removable position; FIG. 19B is a schematic drawing to show a state in which the operation member further moves to the side of the insertable and removable position from the state shown in FIG. 19A; and FIG. 19C is a schematic drawing to show a state in which the operation member moves to the insertable and removable position.

To replace the image carrier unit containing the image carrier PRy, etc., because of an abrasion, degradation, a failure, etc., since the operation member 12 regulates a movement of the image carrier PRy as shown in FIG. 15, first the user rotates the operation member 12. In FIGS. 19A and 19B, the operation joint member 13 joined with the rotation supported part 13*a* movements so as to be pushed backward as the operation member 12 is rotated on the rotation shaft member 12*a*. As the operation joint member 13 moves, the movement member 14 moves backward through the joint shaft 16. As the movement member 14 moves backward, the through part 14*b* of the movement member 14 comes in contact with the supported part 21*b* of the interlocking contact member 21 and the supported part 21*b* moves backward. Accordingly, the movement direction conversion member 17 to which the supported part 21*b* is joined rotates on the direction conversion rotation shaft 18 against the urging force of the urging spring 19.

At this time, the approach and separation member joint part 17*b* of the movement direction conversion member 17 and the joint member 22*b* of the approach and separation member 22 are fitted with play as shown in FIGS. 19A and 19B and thus the approach and separation member 22 scarcely moves until the play disappears. On the other hand, the interlocking contact member 21 rotating in one piece with the movement direction conversion member 17 rotates with rotation of the movement direction conversion member 17 and comes in contact with the interlocking contacted member 8 placed in a non-contact state, pushing the interlocking contacted member 8 upward. When the interlocking contact member 21 pushes the interlocking contacted member 8 upward, the developing device Gy starts to move in a direction away from the image carrier PRy with the rotation shaft 6 as the center against the urging force of the developing device urging member 7.

In FIGS. 19B and 19C, if the operation member 12 further rotates and the movement direction conversion member 17 rotates, the play of the approach and separation member joint part 17*b* and the joint member 22*b* disappears and the approach and separation member joint part 17*b* pushes the joint member 22*b* downward. As the joint member 22*b* moves downward, the approach and separation member 22 starts to fall and the image-writing light irradiation unit 23 starts to move in a direction away from the image carrier PRy.

In FIGS. 3B, 6B, and 19C, when the operation member 12 moves to the insertable and removable position, the latent image-forming unit LHy moves to the latent image-forming unit separation position separated away from the image carrier PRy and the developing device Gy moves to the developing device separation position separated away from the image carrier PRy. In this state, it is made possible to remove and insert the image carrier PRy as the surface does not come in contact with the latent image-forming unit LHy or the developing device Gy. At this time, since the rotation shaft member 12*a* of the operation member 12 is beyond the dead point 13*c*, the operation joint member 13 receives a forward pushing force by the urging force of the urging spring 19 and the operation member 12 naturally receives a moving force to a position below the operation joint member 13. Accordingly, the operation member 12 is automatically kept at the insertable and removable position unless the user adds a force to the operation member 12 for moving the operation member 12 to the side of the usual position.

(Description of Operation of Shield Member at Latent Image-forming Unit Separation Operation Time)

Figure 20:
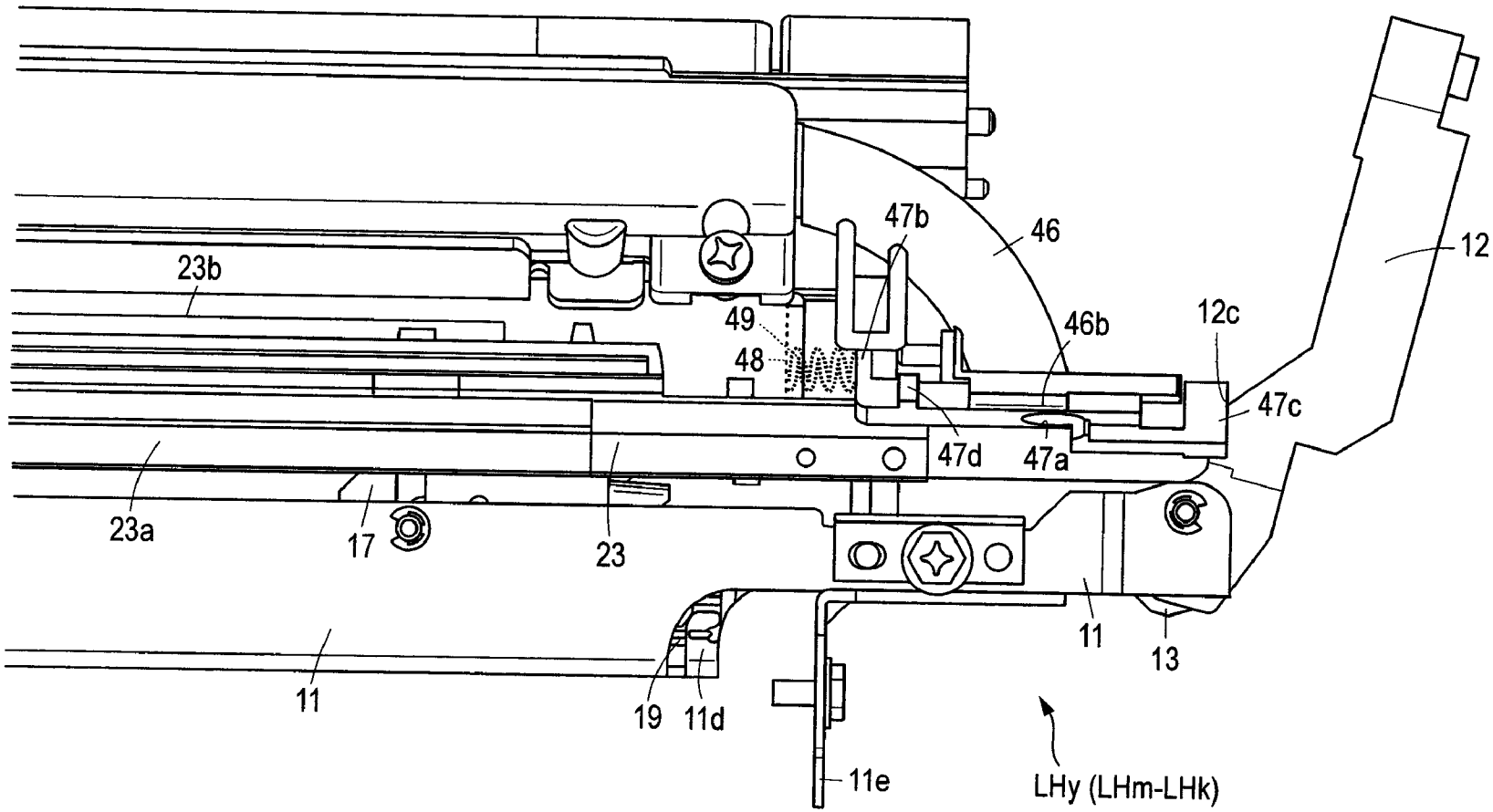
FIG. 20 is a schematic drawing to describe the positional relationship between the latent image-forming unit and an ejection port shutter just after the operation member starts to move from the usual position to the insertable and removable position and is a schematic drawing to show a state in which a residue ejection port is half opened.

FIG. 20 is a schematic drawing to describe the positional relationship between the latent image-forming unit and the ejection port shutter just after the operation member starts to move from the usual position to the insertable and removable position and is a schematic drawing to show a state in which the residue ejection port is half opened.

In FIG. 20, when rotation of the operation member 12 is started from the usual position shown in FIG. 18, the interlocking contact part 12*c* of the operation member 12 moves in the direction in which it is away from the residue ejection port 46*a* with the rotation of the operation member 12, and thus is pressed by the shutter move spring 49 and starts to move toward the forward shield position from the ejection position. Also in this state, the light irradiation part 23*b* of the light-emitting surface of the latent image-forming unit LHy, LHm, LHc, LHk is held above in the gravity direction relative to the residue ejection port 46*a* and the ejection port shutter 47, so that if the developer in the proximity of the residue ejection port 46*a* or the ejection port shutter 47 drops, the light irradiation part 23*b* is held at a position where it is not contaminated, as shown in FIG. 20.

Figure 21:
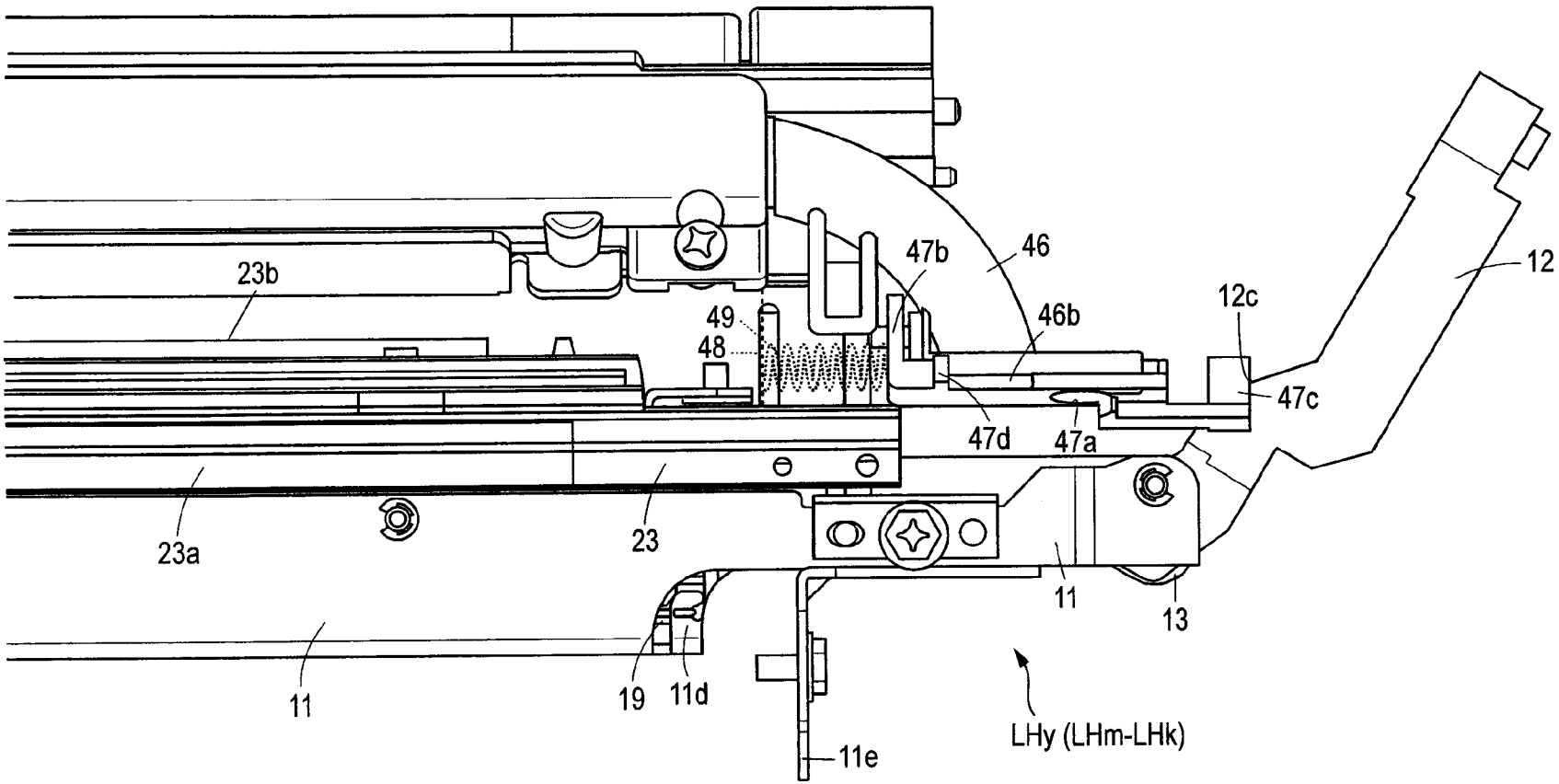
FIG. 21 is a schematic drawing to show a state in which the operation member is moved from the state shown in FIG. 20 to the insertable and removable position and is a schematic drawing to show a state in which the residue ejection port is shielded.

FIG. 21 is a schematic drawing to show a state in which the operation member is moved from the state shown in FIG. 20 to the insertable and removable position and is a schematic drawing to show a state in which the residue ejection port is shielded.

In FIG. 21, if the operation member 12 further rotates from the state shown in FIG. 20, the ejection port shutter 47 is pressed forward by the shutter move spring 49 and moves to the shield position at which a movement is regulated because of contact between the slip out prevention part 47*d* and the shutter guide part 46*b*, thereby shielding the residue ejection port 46*a*. In this state, the light irradiation part 23*b* is separated from the image carrier PRy, PRm, PRc, PRk and moves downward in the gravity direction as compared with the state shown in FIG. 20 by the latent image-forming unit approach and separation mechanism 11 to 22, but is held above in the gravity direction relative to the residue ejection port 46*a* and the ejection port shutter 47, as shown in FIG. 21.

Figure 22:
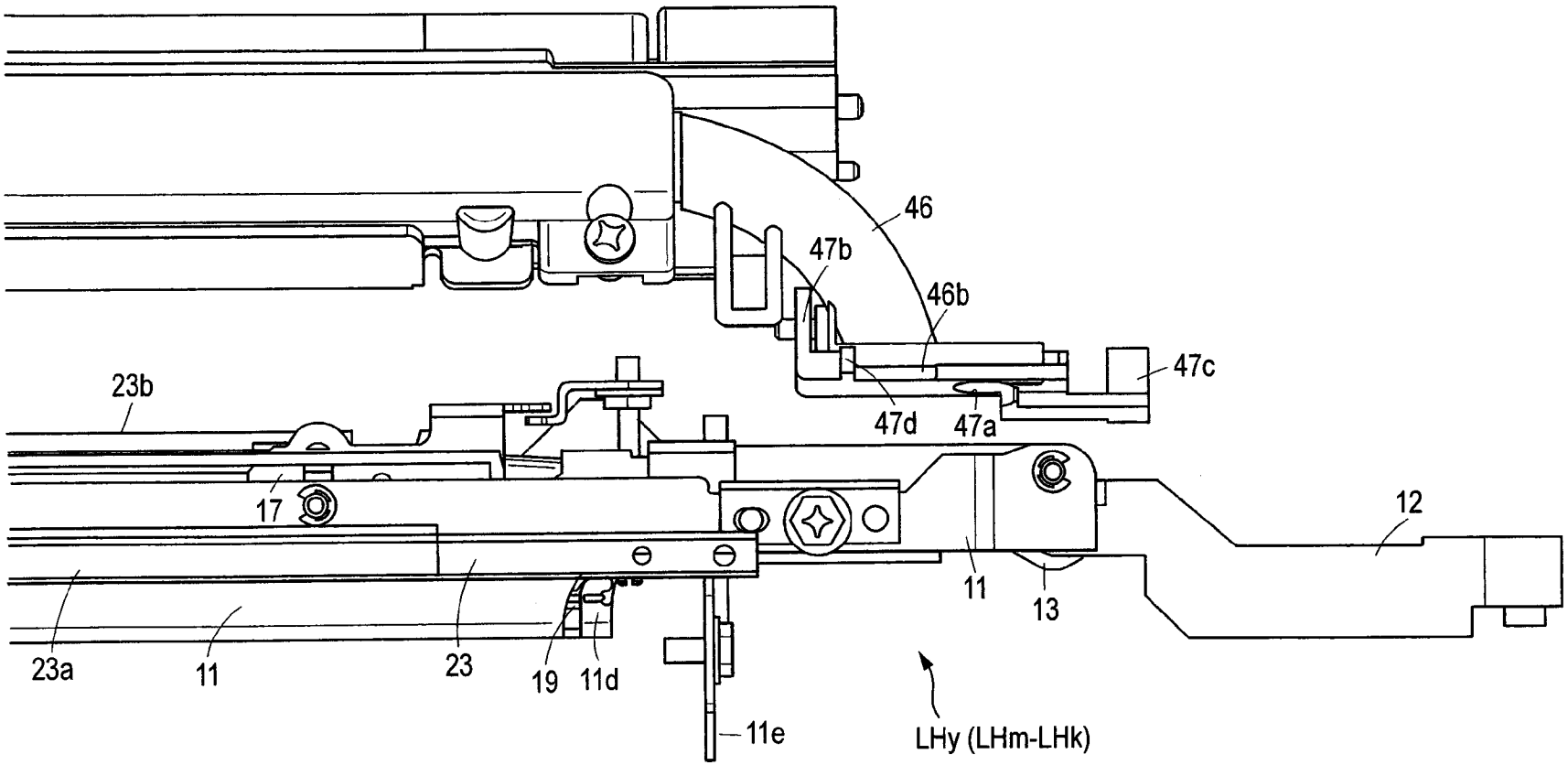
FIG. 22 is a schematic drawing to show a state in which the operation member rotates and moves from the state shown in FIG. 21 to the insertable and removable position.

FIG. 22 is a schematic drawing to show a state in which the operation member rotates and moves from the state shown in FIG. 21 to the insertable and removable position.

In FIG. 22, if the operation member 12 rotates and moves to the insertable and removable position, the ejection port shutter 47 is held at the shield position by the slip out prevention part 47*d*, and the latent image-forming units LHy, LHm, LHc, and LHk move to the latent image-forming unit separation position at which the light irradiation part 23*b* is separated from the image carriers PRy, PRm, PRc, and PRk. In this state, the light irradiation part 23*b* moves downward in the gravity direction relative to the residue ejection port 46*a* shielded by the ejection port shutter 47 to prevent the developer from dropping, as described as for magenta M in FIGS. 22 and 15.

That is, the operation member 12 is moved to the insertable and removable position, whereby the latent image-forming units LHy, LHm, LHc, and LHk and the developing devices Gy, Gm, Gc, and Gk are separated relative to the image carriers PRy, PRm, PRc, and PRk and the residue ejection port 46*a* is shielded by the ejection port shutter 47. In this state, the operation member 12 does not block insertion or removal of the image carrier PRy, PRm, PRc, PRk, and it is made possible to insert, remove, and replace the image carrier unit containing the image carrier PRy, PRm, PRc, PRk, the image carrier cleaner CLy, CLm, CLc, CLk, and the ejection port shutter 47.

In the first embodiment, the image carrier units for four colors are placed side by side so as to incline in a slanting direction with respect to the horizontal plane, and the left latent image-forming unit positions below in the gravity direction relative to the residue ejection port 46*a* of the right image carrier unit. For example, although the light irradiation part 23*b* of the latent image-forming unit LHy of yellow Y positions below in the gravity direction relative to the residue ejection port 46*a* of the image carrier unit of cyan C, the developer replenishment passage 32*y* is placed so as to enter between the residue ejection port 46*a* and the latent image-forming unit LHy and the developer dropped from the residue ejection port 46*a* above in the gravity direction is blocked by the developer replenishment passage 32*y*, making it hard to contaminate the latent image-forming unit LHy.

In the image-forming apparatus U of the first embodiment, the operation member 12 is moved from the insertable and removable position to the usual position, thereby bringing the latent image-forming units LHy, LHm, LHc, and LHk and the developing devices Gy, Gm, Gc, and Gk close to the image carriers PRy, PRm, PRc, and PRk and moving the ejection port shutter 47 to the ejection position for opening the residue ejection port 46*a*.

In the image-forming apparatus U of the first embodiment, the residue ejection passage 46 and the ejection port shutter 47 are placed forward in the insertion/removal direction of the image carrier unit and when the image carrier unit is inserted or removed, the ejection port shutter 47, etc., does not pass through above the latent image-forming unit LHy, LHm, LHc, LHk and the residue deposited on the ejection port shutter 47, etc., is made hard to drop to the latent image-forming units LHy, LHm, LHc, and LHk.

Further, in the image-forming apparatus U of the first embodiment, the direction in which the ejection port shutter 47 moves from the ejection position to the shield position is set to the direction in which it is away from the image-writing light application unit 23 of the latent image-forming unit LHy, LHm, LHc, LHk, and when the ejection port shutter 47 moves, the residue deposited on the ejection port shutter 47 is made hard to drop to the latent image-forming units LHy, LHm, LHc, and LHk.

Second Embodiment

Next, a second exemplary embodiment of the invention will be discussed. Components corresponding to those previously described with reference to the accompanying drawings in the first embodiment are denoted by the same reference numerals in the accompanying drawings in the description of the second embodiment and will not be discussed again in detail.

Figure 23:
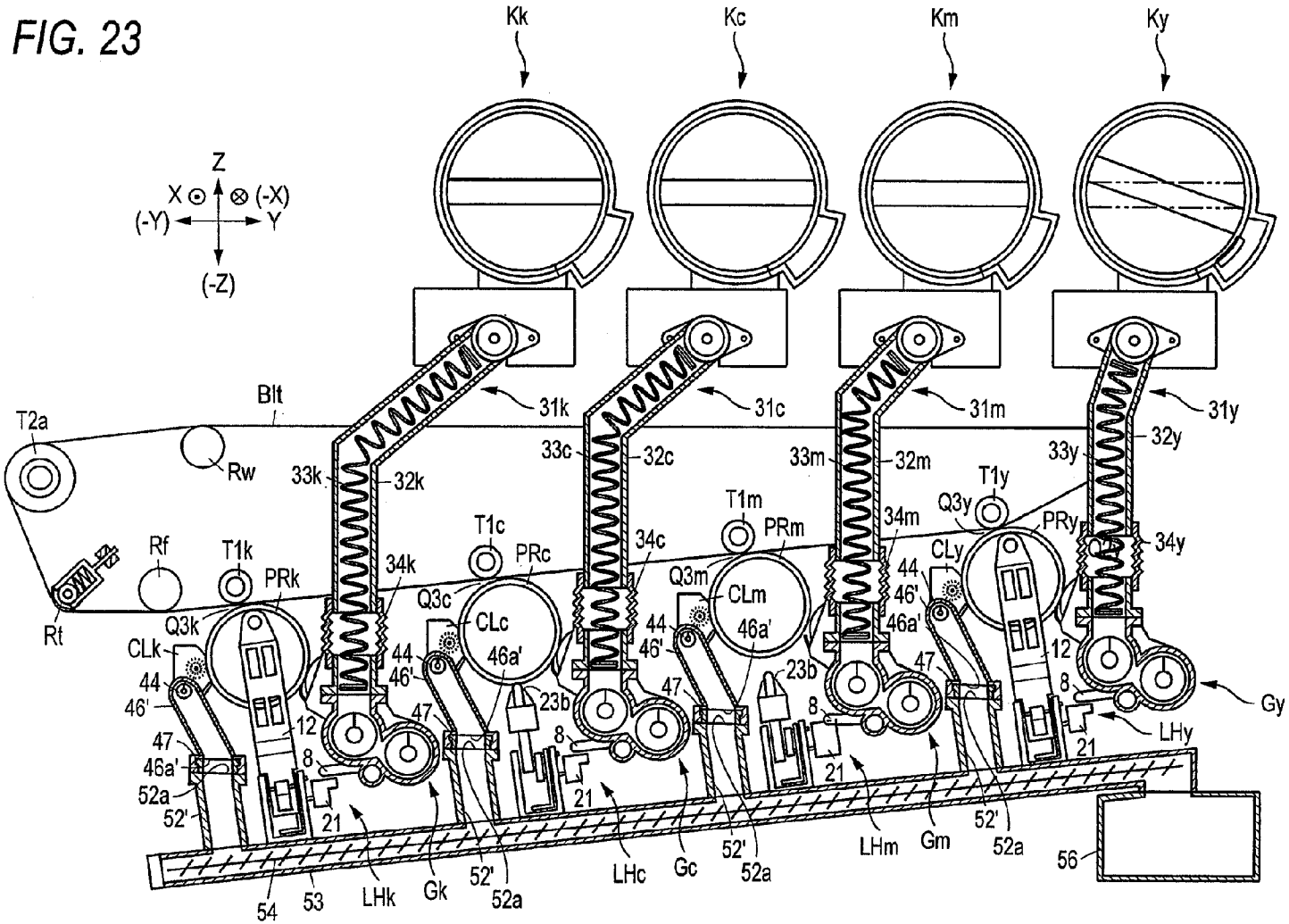
FIG. 23 is a schematic drawing of the main part of an image-forming apparatus of a second exemplary embodiment of the invention and is a drawing corresponding to FIG. 15 in the first embodiment.

The second embodiment differs from the first embodiment only in the following points:

FIG. 23 is a schematic drawing of the main part of an image-forming apparatus of the second embodiment of the invention and is a drawing corresponding to FIG. 15 in the first embodiment.

In FIG. 23, in an image-forming apparatus U of the second embodiment, each residue ejection passage 46' is longer and extends to a lower part than the residue ejection passage 46 of the first embodiment and accordingly the length of each connection passage 52' is shorter than the connection passage 52 of the first embodiment and a residue ejection port 46*a'* is placed in a lower part than the residue ejection port 46*a* of the first embodiment. Accordingly, in FIG. 23, a light irradiation part 23*b* of an light-emitting surface is placed above in the gravity direction relative to the residue ejection port 46*a'* at both a latent image-forming unit approach position and a latent image-forming unit separation position as shown in a latent image-forming unit LHc of cyan C held at the latent image-forming unit approach position and a latent image-forming unit LHm of magenta M moved to the latent image-forming unit separation position.

Although not shown, the position of an ejection port shutter 47 also moves downward with change of the position of the residue ejection port 46*a* and thus the shape of a shield member interlocking part 47*c* of the ejection port shutter 47 is formed longer than the shield member interloking part 47*c* so that the shield member interlocking part 47*c* comes in contact with an operation member 12.

Function of Second Embodiment

In the described image-forming apparatus of the second embodiment, if the light irradiation part 23*b* of latent image-forming unit LHy, LHm, LHc moves up and down, it is held above at all times in the gravity direction relative to the residue ejection port 46*a'* where there is a possibility that a developer may drop.

Third Embodiment

Next, a third exemplary embodiment of the invention will be discussed. Components corresponding to those previously described with reference to the accompanying drawings in the first and second embodiments are denoted by the same reference numerals in the accompanying drawings in the description of the third embodiment and will not be discussed again in detail.

Figure 24:
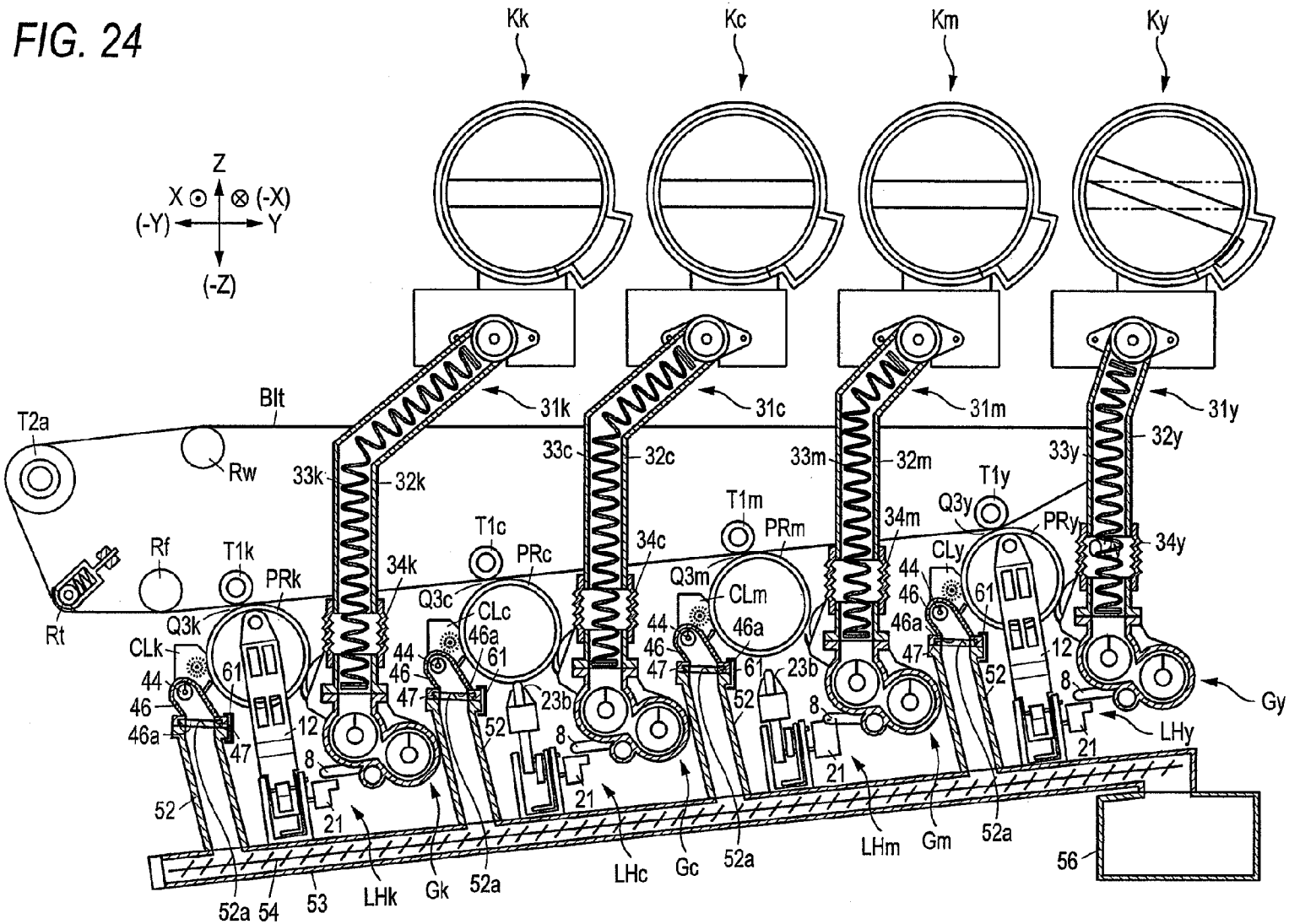
FIG. 24 is a schematic drawing of the main part of an image-forming apparatus of a third exemplary embodiment of the invention and is a drawing corresponding to FIG. 15 in the first embodiment.

The third embodiment differs from the first or second embodiment only in the following points:

FIG. 24 is a schematic drawing of the main part of an image-forming apparatus of the third embodiment of the invention and is a drawing corresponding to FIG. 15 in the first embodiment.

In FIG. 24, an image-forming apparatus of the third embodiment has guide members 61 as an example of entry shield parts fixed to and supported on an image-forming apparatus main body U2 and placed so as to shield each latent image-forming unit LHy, LHm, LHc, LHk and each residue ejection passage 46 for guiding an inserted or removed image carrier unit in an insertion or removal direction.

Function of Third Embodiment

In the described image-forming apparatus of the third embodiment, the guide members 61 guides a movement of the image carrier unit at the insertion or removal time of the image carrier unit and blocks a movement of a developer from the residue ejection passage 46 to the latent image-forming unit LHy, LHm, LHc, LHk.

Fourth Embodiment

Next, a fourth exemplary embodiment of the invention will be discussed. Components corresponding to those previously described with reference to the accompanying drawings in the first to third embodiments are denoted by the same reference numerals in the accompanying drawings in the description of the fourth embodiment and will not be discussed again in detail.

Figure 25:
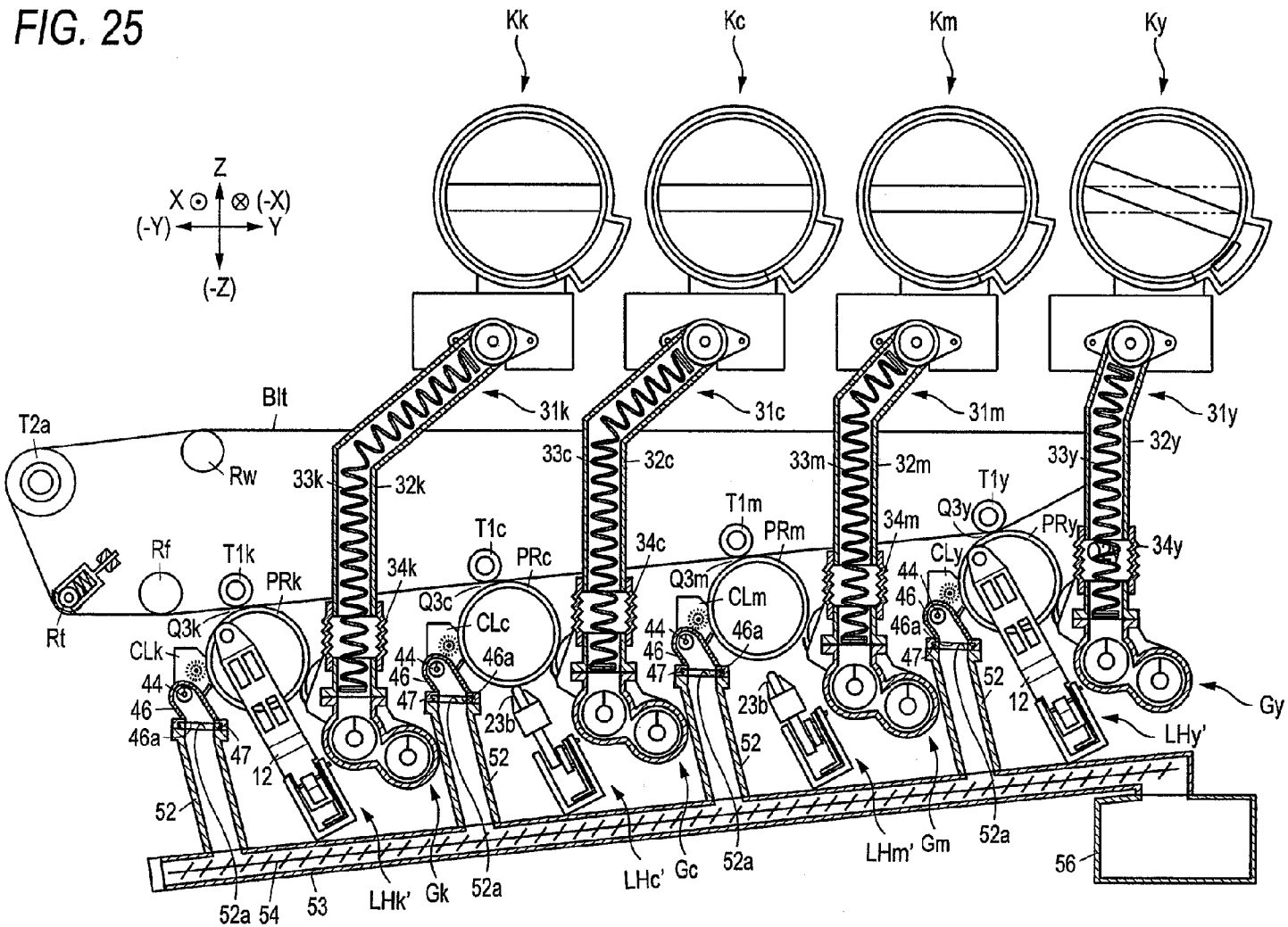
FIG. 25 is a schematic drawing of the main part of an image-forming apparatus of a fourth exemplary embodiment of the invention and is a drawing corresponding to FIG. 15 in the first embodiment.

The fourth embodiment differs from the first, second, or third embodiment only in the following points:

FIG. 25 is a schematic drawing of the main part of an image-forming apparatus of the fourth embodiment of the invention and is a drawing corresponding to FIG. 15 in the first embodiment.

In FIG. 25, in an image-forming apparatus of the fourth embodiment, latent image-forming units LHy', LHm', LHc', and LHk' are placed inclinedly so as become rightward as they go downward, and interlocking mechanisms of the latent image-forming units LHy', LHm', LHc', and LHk' and developing devices Gy, Gm, Gc, and Gk are omitted. In an ejection port shutter 47 of the fourth embodiment, the shape of a shield member interlocking part 47*c* is formed long so that the shield member interlocking part 47*c* comes in contact with an operation member 12 at a distant position as compared with the first embodiment as with the second embodiment.

Function of Fourth Embodiment

In the described image-forming apparatus of the fourth embodiment, when each of latent image-forming units LHy', LHm', LHc', and LHk' moves from a latent image-forming unit approach position indicated in the latent image-forming unit LHc' of cyan C to a latent image-forming unit separation position indicated in the latent image-forming unit LHm' of magenta M, the latent image-forming unit LHy', LHm', LHc', LHk' moves in a direction in which it is away from a residue ejection port 46*a*. That is, a light irradiation part 23*b* moves in a direction in which it is away from the residue ejection port 46*a* where there is a possibility that a developer with the potential for contaminating the light irradiation part 23*b* may drop.

Fifth Embodiment

Next, a fifth exemplary embodiment of the invention will be discussed. Components corresponding to those previously described with reference to the accompanying drawings in the first to fourth embodiments are denoted by the same reference numerals in the accompanying drawings in the description of the fifth embodiment and will not be discussed again in detail.

Figure 26:
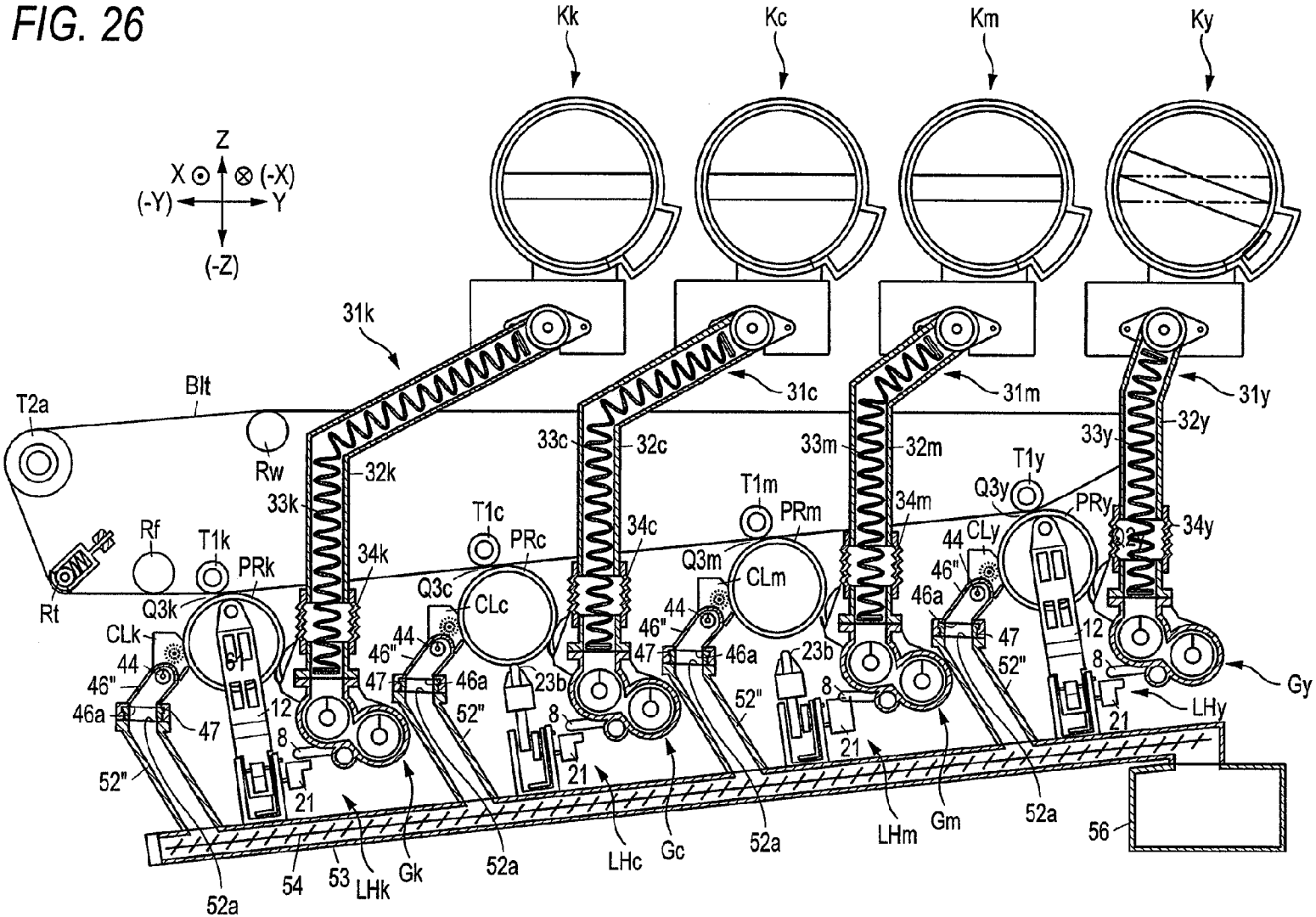
FIG. 26 is a schematic drawing of the main part of an image-forming apparatus of a fifth exemplary embodiment of the invention and is a drawing corresponding to FIG. 15 in the first embodiment, wherein reference numerals and signs in the drawings are set forth below.

The fifth embodiment differs from the first, second, third, or fourth embodiment only in the following points:

FIG. 26 is a schematic drawing of the main part of an image-forming apparatus of the fifth embodiment of the invention and is a drawing corresponding to FIG. 15 in the first embodiment.

In FIG. 26, in an image-forming apparatus of the fifth embodiment, residue ejection passages 46" extend to the left in a slanting downward direction, a direction in which they are away from latent image-forming units LHy, LHm, LHc, and LHk, unlike those of the first embodiment and accordingly, connection passages 52" also extend so as to connect to the residue ejection passages 46". In an ejection port shutter 47 of the fifth embodiment, the shape of a shield member interlocking part 47*c* is changed so that the shield member interlocking part 47*c* comes in contact with an operation member 12 at a distant position as compared with the first embodiment as with the second and fourth embodiments.

Function of Fifth Embodiment

In the described image-forming apparatus of the fifth embodiment, the residue ejection passages 46" where there is a possibility that a developer may drop are placed at positions distant from the latent image-forming units LHy, LHm, LHc, and LHk.

MODIFIED EXAMPLES

Although the invention has been described in detail in its preferred embodiments, it is to be understood that the invention is not limited to the specific embodiments thereof and various modifications and changes can be made without departing from the spirit and the scope of the invention. Modified examples of the invention (H01) to (H03) are illustrated below:

(H01) In the embodiments described above, a copier as the image-forming apparatus is illustrated, but the invention is not limited to it. The image-forming apparatus can also be a facsimile, a printer, or a multiple function processing machine including some or all functions thereof. The image-forming apparatus having the image carriers PRy, PRm, PRc, and PRk, the developing devices Gy, Gm, Gc, and Gk, and the latent image-forming units LHy, LHm, LHc, and LHk for four colors is illustrated, but the invention is not limited to it. The invention can also be applied to a single-color (monochrome) image-forming apparatus and a rotation-type image-forming apparatus including one image carrier and one latent image-forming unit wherein four developing devices rotate and are opposed to the image carrier in order.

(H02) In the embodiments described above, to prevent contamination of the latent image-forming units LHy, LHm, LHc, and LHk, it is desirable that the developer replenishment passages 32*y*, 32*m*, 32*c*, and 32*k* and the residue ejection passages 46 should be placed at the front, but the invention is not limited to the configuration. For example, the developer replenishment passages 32*y*, 32*m*, 32*c*, and 32*k* and the residue ejection passages 46 can also be placed in the rear of the image-forming apparatus main body U2.

(H03) In the embodiments described above, to prevent contamination caused by drop of a residue at the move time of the ejection port shutter 47, it is desirable that the opening/closing direction of the ejection port shutter 47 from the ejection position to the shield position should be set so as to be away from the latent image-forming units LHy, LHm, LHc, and LHk, but the invention is not limited to the configuration. It is not impossible to set the opening/closing direction of the ejection port shutter 47 so as to approach the latent image-forming units LHy, LHm, LHc, and LHk.

What is claimed is:

1. An image-forming apparatus comprising:

an image carrier;

a latent image-forming unit that forms a latent image on a surface of the image carrier;

a cleaning unit for the image carrier, the cleaning unit including a residue removal member that removes a residue deposited on the surface of the image carrier and a residue transport member that transports the residue removed by the residue removal member to an ejection port for ejecting the removed residue;

a residue collecting unit having an receiving port adapted to be able to connect to and be away from the ejection port and to receive the residue ejected from the ejection port;

a shield member capable of shifting between an ejection position where the residue is ejected from the ejection port to the receiving port and a shield position where the shield member shields the ejection port so that the residue is not ejected from the ejection port; and at least one approach and separation mechanism selected from a first approach and separation mechanism and a second approach and separation mechanism, wherein the first and second approach and separation mechanisms move the latent image-forming unit between an approach position where the latent image-forming unit approaches the image carrier and a separate position where the latent image-forming unit is separated from the image carrier, and the first approach and separation mechanism allows the latent image-forming unit to move to the separation position as the shield member shifts to the shield position, and the second approach and separation mechanism restricts a movement of the latent image-forming unit to the separation position in a state in which the shield member is placed at the ejection position.

2. The image-forming apparatus according to claim 1, wherein the first approach and separation mechanism and the second approach and separation mechanism are the same approach and separation mechanism.

3. The image-forming apparatus according to claim 1, further comprising:

a plurality of image carriers;

a plurality of latent image-forming units disposed corresponding to the plurality of image carriers;

a plurality of developing units disposed corresponding to the plurality of image carriers, each of the developing units developing a latent image on a surface of an image carrier to a visible image; and a developer replenishment passage that is connected to the developing units and transports a replenishment developer, the developer replenishment passage being disposed between a latent image-forming unit corresponding to a first image carrier of the image carriers and the ejection port of a second image carrier adjacent to the first image carrier, wherein the latent image-forming unit corresponding to the first image carrier has a light-emitting surface placed below in a gravity direction with respect to the ejection port of the cleaning unit of the second image carrier in a state in which the latent image-forming unit moves to the separation position.

4. The image-forming apparatus according to claim 1, wherein the approach and separation mechanism has an operation member supported on a frame of the latent image-forming unit for rotation, the operation member being for moving the latent image-forming unit between the approach position and the separation position;

the shield member has an interlocking part adopted to be able to come in contact with the operation member; and the image-forming apparatus further comprises an urging member that urges the interlocking part in a direction in which the interlocking part comes in contact with the operation member and associates a movement of the interlocking part with a rotation movement of the operation member.

5. The image-forming apparatus according to claim 1, wherein when the latent image-forming unit moves from the approach position to the separation position, the latent-forming unit moves in a direction away from the ejection port.

6. The image-forming apparatus according to claim 1, wherein the cleaning unit includes a residue ejection passage having the ejection port and extending in a direction away from the latent-image forming unit.

7. An image-forming apparatus comprising:

an image carrier;

a latent image-forming unit that forms a latent image on a surface of the image carrier;

a cleaning unit for the image carrier, the cleaning unit including a residue removal member that removes a residue deposited on the surface of the image carrier and a residue transport member that transports the removed residue to an ejection port for ejecting the removed residue;

a residue collecting unit having an receiving port adapted to be able to connect to and be away from the ejection port and to receive the residue ejected from the ejection port;

a shield member capable of shifting between an ejection position where the residue is ejected from the ejection port to the receiving port and a shield position where the shield member shields the ejection port so that the residue is not ejected from the ejection port;

an approach and separation mechanism that moves the latent image-forming unit between an approach position where the latent image-forming unit approaches the image carrier and a separate position where the latent image-forming unit is separated from the image carrier; and an interlocking mechanism that interlocks a movement of the shield member from the ejection position to the shield position with a movement of the latent image-forming unit from the approach position to the separation position, the interlocking mechanism moving the latent image-forming unit to the separation position after the shield member shifts to the shield position.

8. The image-forming apparatus according to claim 7, further comprising:

a plurality of image carriers;

a plurality of latent image-forming units disposed corresponding to the plurality of image carriers;

a plurality of developing units disposed corresponding to the plurality of image carriers, each of the developing units developing a latent image on a surface of an image carrier to a visible image; and a developer replenishment passage that is connected to the developing units and transports a replenishment developer, the developer replenishment passage being disposed between a latent image-forming unit corresponding to a first image carrier of the image carriers and the ejection port of a second image carrier adjacent to the first image carrier, wherein the latent image-forming unit corresponding to the first image carrier has a light-emitting surface placed below in a gravity direction with respect to the ejection port of the cleaning unit of the second image carrier in a state in which the latent image-forming unit moves to the separation position.

9. The image-forming apparatus according to claim 7, wherein the approach and separation mechanism has an operation member supported on a frame of the latent image-forming unit for rotation, the operation member being for moving the latent image-forming unit between the approach position and the separation position;

the shield member has an interlocking part adopted to be able to come in contact with the operation member; and the image-forming apparatus further comprises an urging member that urges the interlocking part in a direction in which the interlocking part comes in contact with the operation member and associates a movement of the interlocking part with a rotation movement of the operation member.

10. The image-forming apparatus according to claim 7, wherein when the latent image-forming unit moves from the approach position to the separation position, the latent-forming unit moves in a direction away from the ejection port.

11. The image-forming apparatus according to claim 7, wherein the cleaning unit includes a residue ejection passage having the ejection port and extending in a direction away from the latent-image forming unit.

12. An image-forming apparatus comprising:

an image carrier;

a latent image-forming unit that forms a latent image on a surface of the image carrier, the latent image-forming unit being disposed below in a gravity direction with respect to the image carrier;

a cleaning unit for the image carrier, the cleaning unit including a residue removal member that removes a residue deposited on the surface of the image carrier and a residue transport member that transports the removed residue to an ejection port for ejecting the removed residue;

a residue collecting unit having an receiving port adapted to be able to connect to and be away from the ejection port and to receive the residue ejected from the ejection port;

a shield member capable of shifting between an ejection position where the residue is ejected from the ejection port to the receiving port and a shield position where the shield member shields the ejection port so that the residue is not ejected from the ejection port;

an approach and separation mechanism that moves the latent image-forming unit between: an approach position where the latent image-forming unit approaches the image carrier and a light-emitting surface of the latent image-forming unit opposed to the image carrier is placed above in the gravity direction with respect to the ejection portion; and a separation position where the latent image-forming unit is separated from the image carrier and the light-emitting surface is placed below in the gravity direction with respect to the ejection port; and an interlocking mechanism that interlocks a movement of the shield member from the ejection position to the shield position with a movement of the latent image-forming unit from the approach position to the separation position, the interlocking mechanism moving the shield member to the shield position before the light-emitting surface moves downward in the gravity direction with respect to the ejection port.

13. The image-forming apparatus according to claim 12, further comprising:

a plurality of image carriers;

a plurality of latent image-forming units disposed corresponding to the plurality of image carriers;

a plurality of developing units disposed corresponding to the plurality of image carriers, each of the developing units developing a latent image on a surface of an image carrier to a visible image; and a developer replenishment passage that is connected to the developing units and transports a replenishment developer, the developer replenishment passage being disposed between a latent image-forming unit corresponding to a first image carrier of the image carriers and the ejection port of a second image carrier adjacent to the first image carrier, wherein the latent image-forming unit corresponding to the first image carrier has a light-emitting surface placed below in the gravity direction with respect to the ejection port of the cleaning unit of the second image carrier in a state in which the latent image-forming unit moves to the separation position.

14. The image-forming apparatus according to claim 12, wherein the approach and separation mechanism has an operation member supported on a frame of the latent image-forming unit for rotation, the operation member being for moving the latent image-forming unit between the approach position and the separation position;

the shield member has an interlocking part adopted to be able to come in contact with the operation member; and the image-forming apparatus further comprises an urging member that urges the interlocking part in a direction in which the interlocking part comes in contact with the operation member and associates a movement of the interlocking part with a rotation movement of the operation member.

15. The image-forming apparatus according to claim 12, wherein when the latent image-forming unit moves from the approach position to the separation position, the latent-forming unit moves in a direction away from the ejection port.

16. The image-forming apparatus according to claim 12, wherein the cleaning unit includes a residue ejection passage having the ejection port and extending in a direction away from the latent-image forming unit.

17. An image-forming apparatus comprising:

an image carrier;

a latent image-forming unit that forms a latent image on a surface of the image carrier, the latent image-forming unit being disposed below in a gravity direction with respect to the image carrier;

a cleaning unit for the image carrier, the cleaning unit including a residue removal member that removes a residue deposited on the surface of the image carrier and a residue transport member that transports the removed residue to an ejection port for ejecting the removed residue;

a residue collecting unit having an receiving port adapted to be able to connect to and be away from the ejection port and to receive the residue ejected from the ejection port, a residue transporting member that transports the residue ejected from the ejection port, and a residue collecting vessel that collects the transported residue;

a shield member capable of shifting between an ejection position where the residue is ejected from the ejection port to the receiving port and a shield position where the shield member shields the ejection port so that the residue is not ejected from the ejection port;

an approach and separation mechanism that moves the latent image-forming unit between an approach position where the latent image-forming unit approaches the image carrier and a separate position where the latent image-forming unit is separated from the image carrier; and at least one of movement restriction members selected from a first movement restriction member and a second movement restriction member, wherein the first movement restriction member allows the shield member to move from the shield position to the ejection position as the latent image-forming unit moves to the approach position, and the second movement restriction member restricts a movement of the shield member to the ejection position in a state in which the latent image-forming unit moves to the separation position.

18. The image-forming apparatus according to claim 17, wherein the first movement restriction member and the second movement restriction member are the same movement restriction member.

19. The image-forming apparatus according to claim 17, further comprising:

a plurality of image carriers;

a plurality of latent image-forming units disposed corresponding to the plurality of image carriers;

a plurality of developing units disposed corresponding to the plurality of image carriers, each of the developing units developing a latent image on a surface of an image carrier to a visible image; and a developer replenishment passage that is connected to the developing units and transports a replenishment developer, the developer replenishment passage being disposed between a latent image-forming unit corresponding to a first image carrier of the image carriers and the ejection port of a second image carrier adjacent to the first image carrier, wherein the latent image-forming unit corresponding to the first image carrier has a light-emitting surface placed below in a gravity direction with respect to the ejection port of the cleaning unit of the second image carrier in a state in which the latent image-forming unit moves to the separation position.

20. The image-forming apparatus according to claim 17, wherein the approach and separation mechanism has an operation member supported on a frame of the latent image-forming unit for rotation, the operation member being for moving the latent image-forming unit between the approach position and the separation position;

the shield member has an interlocking part adopted to be able to come in contact with the operation member; and the image-forming apparatus further comprises an urging member that urges the interlocking part in a direction in which the interlocking part comes in contact with the operation member and associates a movement of the interlocking part with a rotation movement of the operation member.

21. The image-forming apparatus according to claim 17, wherein when the latent image-forming unit moves from the approach position to the separation position, the latent-forming unit moves in a direction away from the ejection port.

22. The image-forming apparatus according to claim 17, wherein the cleaning unit includes a residue ejection passage having the ejection port and extending in a direction away from the latent-image forming unit.

* * * * *